US010337744B2

(12) United States Patent
Kitaura et al.

(10) Patent No.: US 10,337,744 B2
(45) Date of Patent: Jul. 2, 2019

(54) HEAT COOKING DEVICE

(71) Applicant: Sharp Kabushiki Kaisha, Sakai-shi, Osaka (JP)

(72) Inventors: Tomohiro Kitaura, Sakai (JP); Yoshikazu Kitaguchi, Sakai (JP); Noriko Izumi, Sakai (JP); Mari Nishide, Sakai (JP); Junichi Takeuchi, Sakai (JP); Yasuhiko Kamii, Sakai (JP); Yoshihiro Okamoto, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 232 days.

(21) Appl. No.: 15/121,467

(22) PCT Filed: Jun. 9, 2015

(86) PCT No.: PCT/JP2015/066591
§ 371 (c)(1),
(2) Date: Aug. 25, 2016

(87) PCT Pub. No.: WO2015/190475
PCT Pub. Date: Dec. 17, 2015

(65) Prior Publication Data

US 2016/0370014 A1 Dec. 22, 2016

(30) Foreign Application Priority Data

Jun. 13, 2014 (JP) ..... 2014-122822

(51) Int. Cl.
*F24C 15/20* (2006.01)
*F24C 7/02* (2006.01)
(Continued)

(52) U.S. Cl.
CPC ..... *F24C 15/2007* (2013.01); *F24C 7/006* (2013.01); *F24C 15/327* (2013.01);
(Continued)

(58) Field of Classification Search
None
See application file for complete search history.

(56) References Cited

U.S. PATENT DOCUMENTS 9,879,866 B2 * 1/2018 Suenaga ..... F24C 15/327
2012/0043315 A1 * 2/2012 Suenaga ..... F24C 15/006 219/682

(Continued)

FOREIGN PATENT DOCUMENTS

JP 59-45894 U 3/1984
JP 61-164917 U 10/1986

(Continued)

OTHER PUBLICATIONS

JP5084897B2 , Nov. 2012, Heating Cooking Device, Komuro et al, partial translation; equivalent to WO 2012/070488 (A1).*

(Continued)

*Primary Examiner* — Joseph M Pelham
(74) *Attorney, Agent, or Firm* — ScienBiziP, P.C.

(57) ABSTRACT

A heat cooking device comprises a casing, a heating chamber, and an exhaust duct having an outlet provided on a rear edge side of an upper surface of the casing such that exhaust air from an inside of the casing is blown out forward. An upper outer wall surface of a rear surface plate of the casing is covered by the exhaust duct to form an exhaust passage between the casing and the exhaust duct. A guidance part is provided inside the exhaust passage, and guides the water infiltrating into the exhaust passage through the outlet of the exhaust duct, downward inside the exhaust passage.

5 Claims, 21 Drawing Sheets

(51) Int. Cl.

| | |
|---|---|
| ***F24C 7/00*** | (2006.01) |
| ***F24C 15/32*** | (2006.01) |
| ***H05B 6/64*** | (2006.01) |

(52) U.S. Cl.

CPC ..... *H05B 6/645* (2013.01); *H05B 6/6426* (2013.01); *H05B 6/6458* (2013.01); *H05B 6/6479* (2013.01); *H05B 6/6485* (2013.01); *F24C 15/20* (2013.01)

(56) References Cited

U.S. PATENT DOCUMENTS

| | | | | |
|---|---|---|---|---|
| 2012/0118169 | A1* | 5/2012 | Hirano | F24C 15/006 99/325 |
| 2012/0118279 | A1* | 5/2012 | Asami | F24C 15/2007 126/20 |
| 2016/0066738 | A1* | 3/2016 | Shibuya | A47J 27/04 219/401 |
| 2016/0360916 | A1* | 12/2016 | Utsumi | A47J 27/04 |

FOREIGN PATENT DOCUMENTS

| | | | |
|---|---|---|---|
| JP | 2009-052861 | A | 3/2009 |
| WO | 2012/070488 | A1 | 5/2012 |

OTHER PUBLICATIONS

Official Communication issued in International Patent Application No. PCT/JP2015/066591, dated Sep. 1, 2015.

* cited by examiner (b)

Fig.18A (a)

| INPUT VOLTAGE | COLD | | | | HOT | | | |
|---|---|---|---|---|---|---|---|---|
| | INPUT CURRENT | | POWER CONSUMPTION | | INPUT CURRENT | | POWER CONSUMPTION | |
| 187 V | 12.80 A | −0.6% | 2266 W | −19.2% | 12.63 A | −1.9% | 2330 W | −15.7% |
| 198 V | 12.76 A | −0.9% | 2437 W | −13.1% | 12.79 A | −0.6% | 2493 W | −9.8% |
| 209 V | 12.81 A | −0.5% | 2620 W | −6.6% | 12.92 A | 0.4% | 2659 W | −3.8% |
| 220 V | 12.88 A | | 2805 W | | 12.87 A | | 2765 W | |
| 231 V | 12.99 A | 0.9% | 2945 W | 5.0% | 12.92 A | 0.4% | 2897 W | 4.8% |
| 242 V | 13.11 A | 1.8% | 3100 W | 10.5% | 12.90 A | 0.2% | 3015 W | 9.0% |

Fig.18B (b)

| INPUT VOLTAGE | COLD | | | | HOT | | | |
|---|---|---|---|---|---|---|---|---|
| | INPUT CURRENT | | POWER CONSUMPTION | | INPUT CURRENT | | POWER CONSUMPTION | |
| 187 V | 16.00 A | 24.2% | 2834 W | 1.0% | 15.34 A | 19.2% | 2831 W | 2.4% |
| 198 V | 14.83 A | 15.1% | 2834 W | 1.0% | 14.53 A | 12.9% | 2831 W | 2.4% |
| 209 V | 13.85 A | 7.5% | 2834 W | 1.0% | 13.75 A | 6.9% | 2831 W | 2.4% |
| 220 V | 12.88 A | | 2805 W | | 12.87 A | | 2765 W | |
| 231 V | 12.50 A | −2.9% | 2834 W | 1.0% | 12.62 A | −1.9% | 2831 W | 2.4% |
| 242 V | 11.99 A | −6.9% | 2857 W | 1.9% | 12.01 A | −6.7% | 2831 W | 2.4% |

HEAT COOKING DEVICE

TECHNICAL FIELD

The present invention relates to a heat cooking device.

BACKGROUND ART

Conventionally, there has been a heat cooking device provided with an exhaust duct for blowing out exhaust air from a heating chamber forward on a rear edge side of an upper surface of a casing (refer to Japanese Patent Laid-open Publication No. JP 2009-052861 (Patent Document 1), for example).

In the heat cooking device, the exhaust duct is mounted so as to be laid between an upper surface plate and a rear surface plate of the casing.

PRIOR ART DOCUMENT

Patent Document

Patent Document 1: Japanese Patent Laid-open Publication No. JP 2009-052861

SUMMARY OF THE INVENTION

Problems to be Solved by the Invention

In the conventional heat cooking device, when water accidentally spills on the upper surface of the casing, the spilled water may infiltrate into the casing through an outlet of the exhaust duct.

An object of the present invention is to provide a heat cooking device in which even when water is wrongly overflown on an upper surface of a casing, the overflown water can be prevented from infiltrating into the casing through an outlet of an exhaust duct.

Solution to the Problems

In view of the foregoing, a heat cooking device comprises:

a casing;

a heating chamber disposed inside the casing; and an exhaust duct having an outlet provided on a rear edge side of an upper surface of the casing such that exhaust air from an inside of the casing is blown out forward, wherein an upper outer wall surface of a rear surface plate of the casing is covered by the exhaust duct to form an exhaust passage between the casing and the exhaust duct, a bottom portion of the exhaust passage is inclined obliquely downward in one of right and left directions of the casing, and an opening portion is provided between the rear surface plate of the casing and the exhaust duct on a lower side of the bottom portion of the exhaust passage.

In another aspect of the invention, a heat cooking device further comprises a guidance part that is provided inside the exhaust passage, and guides the water infiltrating into the exhaust passage through the outlet of the exhaust duct, downward inside the exhaust passage, wherein the guidance part includes a partition plate erected on at least one of an inner wall surface of the exhaust duct and an outer wall surface of the rear surface plate of the casing.

In another aspect of the invention, the guidance part includes at least one of a recess and a protrusion provided in the rear surface plate of the casing.

In another aspect of the invention, a stepped part recessed forward is provided on an upper side of the rear surface plate of the casing, and a stepped part of the casing is covered by the exhaust duct, so that an outer wall surface of the exhaust duct is located on the same plane as an outer wall surface below the stepped part, in the outer wall surface of the rear surface plate of the casing, or the outer wall surface of the exhaust duct is located in front of the outer wall surface below the stepped part, in the outer wall surface of the rear surface plate of the casing.

In another aspect of the invention, an exhaust air hole that blows out exhaust air from the inside of the casing toward the exhaust passage is provided on an upper side of the rear surface plate of the casing, the exhaust air hole being open rearward in a horizontal direction or in an obliquely downward direction.

In another aspect of the invention, a heat cooking device further comprises a rib provided in a right-left direction of the casing so as to protrude obliquely upward from a lower side of the outlet of the exhaust duct, wherein a groove is formed between the rib and an upper surface plate of the casing in the right-left direction of the casing.

EFFECTS OF THE INVENTION

According to the invention, as is evident from above, the upper outer wall surface of the rear surface plate of the casing is covered by the exhaust duct, so that the exhaust passage is formed between the outer wall surface of the rear surface plate of the casing and the exhaust duct, so that water infiltrating into the exhaust passage from the upper surface side of the casing through the outlet of the exhaust duct is guided obliquely downward by the guidance part provided inside the exhaust passage along the outer wall surface of the rear surface plate of the casing. Therefore, even when the water is wrongly overflown on the upper surface of the casing, the overflown water can be prevented from infiltrating into the casing through the outlet of the exhaust duct.

BRIEF DESCRIPTION OF THE DRAWINGS

FIG. 18A is a diagram illustrating a relation of power consumption to an input voltage of a heat cooking device, according to the conventional heat cooking device.

FIG. 18B is a diagram illustrating a relation of power consumption to the input voltage of the heat cooking device of the fourth embodiment.

EMBODIMENTS OF THE INVENTION

Figure 1:
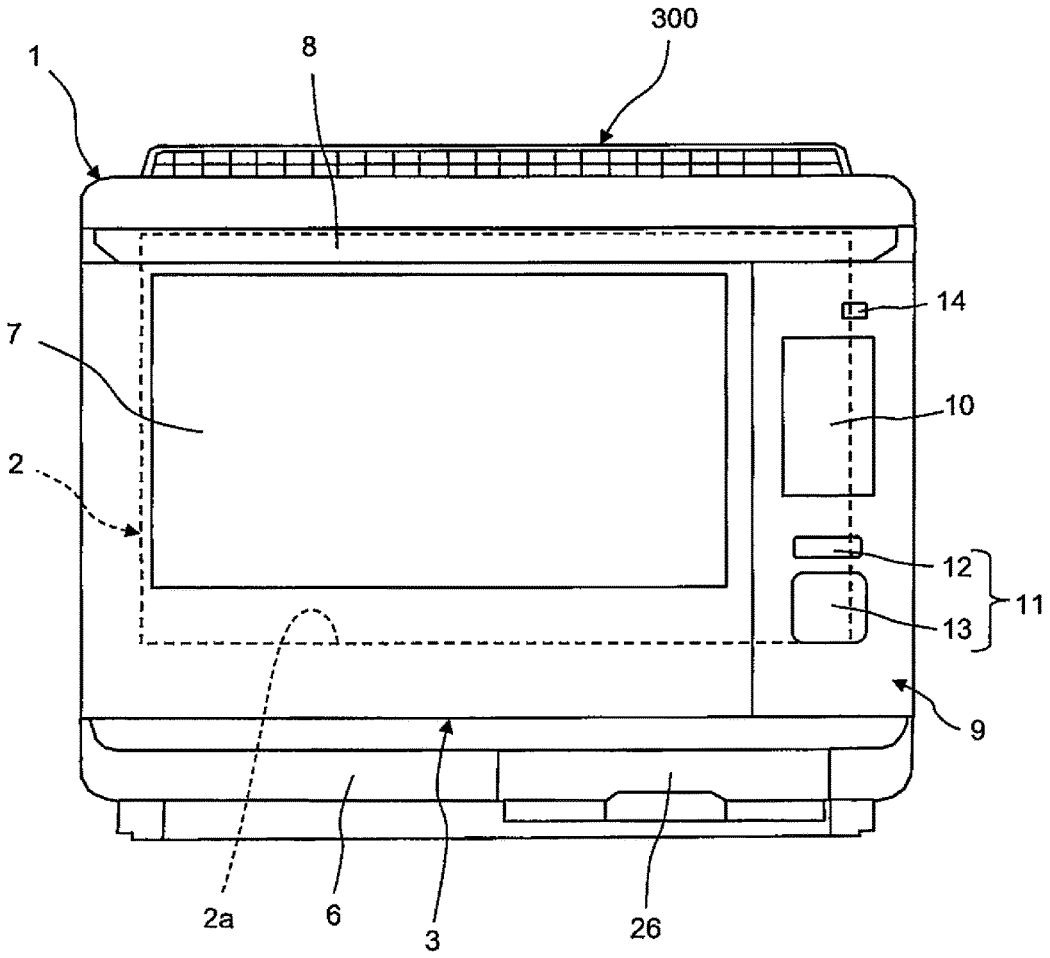
FIG. 1 is a schematic front view of a heat cooking device with a door closed according to a first embodiment of the present invention.

Hereinafter, a heat cooking device of the present invention will be described in detail by way of embodiments illustrated in the drawings.

[First Embodiment]

FIG. 1 is a schematic front view of a heat cooking device with a door closed according to a first embodiment of the present invention. Moreover, FIG. 2 is a schematic front view of the above heat cooking device with the door opened.

Figure 2:
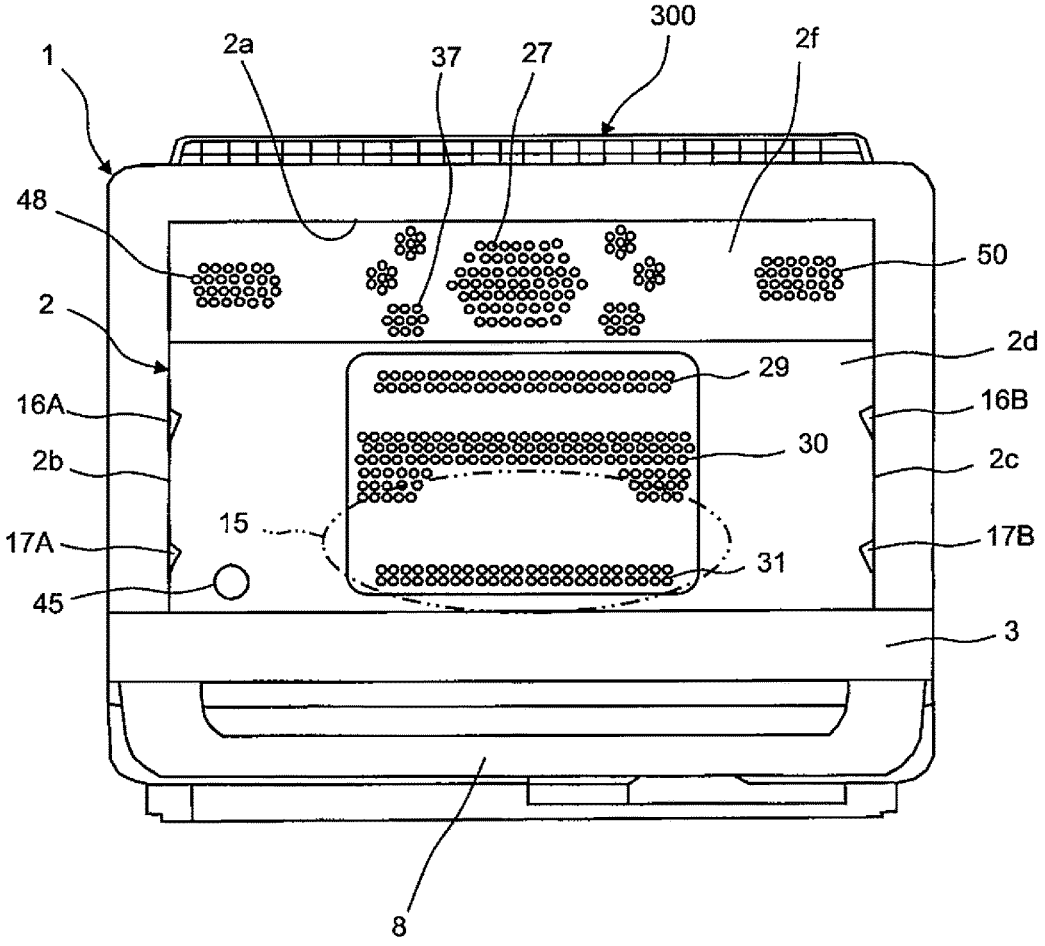
FIG. 2 is a schematic front view of the heat cooking device with the door opened.

The heat cooking device according to the first embodiment includes a body casing 1 having a shape of a rectangular parallelepiped, a heating chamber 2 provided in the body casing 1 and having an opening portion 2*a* on its front side, a door 3 arranged to open and close the opening portion 2*a* of the heating chamber 2, and a magnetron 4 (shown in FIG. 5) arranged to supply microwaves into the heating chamber 2 in which a food is to be accommodated as shown in FIGS. 1 and 2. The magnetron 4 is an example of a microwave generator.

An exhaust duct 300 is provided in a rear part of an upper surface of the body casing 1. Moreover, a dew receiver 6 is removably attached to a lower part of a front surface of the body casing 1. The dew receiver 6 is positioned below the door 3 and is enabled to receive water droplets from a rear surface of the door 3 (a surface on the heating chamber 2 side). A water supply tank 26 which will be described below is also attached removably in the lower front of the body casing 1.

The door 3 is attached at the front surface side of the body casing 1 so as to be rotatable with a lower side of the door set to be an axis of rotation. A front surface of the door 3 (a surface at an opposite side to the heating chamber 2) is provided with a transparent outer glass 7 which is heat resistant. Moreover, the door 3 has a handle 8 positioned above the outer glass 7 and an operation panel 9 provided at a right side of the outer glass 7.

The operation panel 9 has a color liquid crystal display portion 10 and a button group 11. The button group 11 includes a cancel key 12 to be pressed down when stopping heating halfway or at other occasions, and a warming start key 13 to be pressed when starting heating. Moreover, the operation panel 9 is provided with an infrared ray receiving portion 14 for receiving infrared rays from a smartphone or the like.

A substance 15 to be heated is accommodated in the heating chamber 2. Metallic cooking trays 91 and 92 (shown in FIG. 3) can be put in/out of the heating chamber 2. Internal surfaces of a left side portion 2*b* and a right side portion 2*c* in the heating chamber 2 are provided with upper tray holders 16A and 16B for supporting the cooking tray 91. Furthermore, lower tray holders 17A and 17B for supporting the cooking tray 92 are provided on the internal surfaces of the right side portion 2*c* and the left side portion 2*b* in the heating chamber 2 so as to be positioned below the upper tray holders 16A and 16B.

The cooking trays 91 and 92 have a gap against a rear portion 2*d* of the heating chamber 2 when they are disposed in the heating chamber 2. In more detail, contact portions (not shown) are provided at rear end portions of the upper tray holders 16A, 16B and the lower tray holders 17A, 17B, respectively. These contact portions come into contact with the cooking trays 91, 92 before those cooking trays 91, 92 come into contact with the rear portion 2*d* of the heating chamber 2 so that rearward movement of the cooking trays 91, 92 is restricted. At this time, a gap having a length in a longitudinal (front-and-rear) direction, for example, 3 mm may be generated between the cooking trays 91 and 92 and the rear portion 2*d* of the heating chamber 2.

Figure 3:
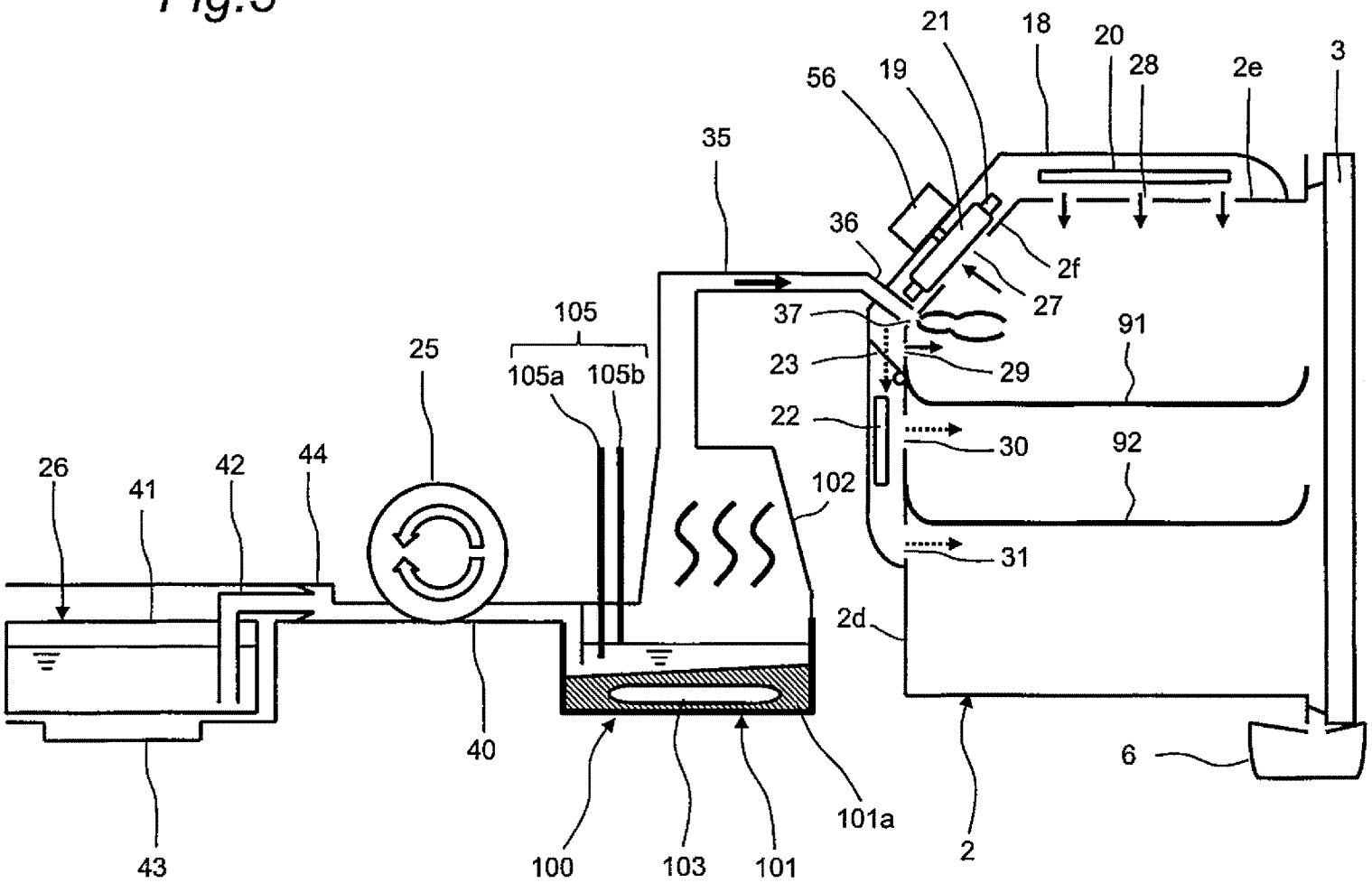
FIG. 3 is a schematic diagram for illustrating a configuration of a main part of the heat cooking device.

FIG. 3 is a schematic view for explaining a structure of a main part of the heat cooking device. FIG. 3 shows a state in which the heating chamber 2 is seen from a left side. In FIG. 3, components identical with the components in FIG. 1 are denoted by the same reference numerals.

The heat cooking device includes a circulation duct 18, a circulation fan 19, an upper heater 20, a middle heater 21, a lower heater 22, a circulation damper 23, a tube pump 25, a water supply tank 26, and a steam generating device 100. The upper heater 20, the middle heater 21 and the lower heater 22 each are provided in the form of a sheath heater, for example. The circulation duct 18 is an example of the duct. Furthermore, the circulation damper 23 is an example of the damper. Moreover, the tube pump 25 is an example of the pump. In the present invention, the pump is not limited to the tube pump, but is only required to be a pump capable of switching between a water supplying operation and a water discharging operation depending on a driving direction.

An upper part 2*e* of the heating chamber 2 communicates with the rear portion 2*d* of the heating chamber 2 through an inclined portion 2*f* which is inclined with respect to a horizontal direction. The inclined portion 2*f* is provided with a plurality of suction ports 27 which are opposed to the circulation fan 19 (see FIG. 2). Moreover, a plurality of upper outlets 28 is provided in the upper part 2*e* of the heating chamber 2. Furthermore, the rear portion 2*d* of the heating chamber 2 is provided with first rear outlets 29, second rear outlets 30, and third rear outlets 31 (see FIG. 2). FIG. 3 shows only three of the suction ports 27. In addition, FIG. 3 shows only one of the first rear outlets 29, one of the second rear outlets 30 and one of the third rear outlets 31.

The circulation duct 18 communicates with the inside of the heating chamber 2 through the suction ports 27, the upper outlets 28 and the first to third rear outlets 29 to 31. The circulation duct 18 is provided so as to range from the upper side to the rear side of the heating chamber 2 and is extended to take an inverted L shape. Moreover, a width in a lateral (left-right) direction of the circulation duct 18 is set to be smaller than a width in a lateral direction of the heating chamber 2.

The circulation fan 19 is a centrifugal fan and is driven by a motor 56 for a circulation fan (referred to as "circulation fan motor 56" below). When the circulation fan motor 56 drives the circulation fan 19, air or saturated steam (which will be hereinafter referred to as "air or the like") in the heating chamber 2 is sucked through the suction ports 27 into the circulation duct 18 and is caused to flow outward in a radial direction of the circulation fan 19. In more detail, at an upper side of the circulation fan 19, the air or the like flows obliquely upward from the circulation fan 19 and then flows forward from a rear part. On the other hand, at a lower side of the circulation fan 19, the air or the like flows obliquely downward from the circulation fan 19 and then flows downward from an upper part. The air or the like is an example of a heating medium.

The upper heater 20 is disposed in the circulation duct 18 and is opposed to the upper part 2*e* of the heating chamber 2. The upper heater 20 heats the air or the like flowing to the upper outlets 28.

The middle heater 21 is formed circularly and surrounds the circulation fan 19. The middle heater 21 heats the air or the like supplied from the circulation fan 19 toward the upper heater 20 or heats the air or the like supplied from the circulation fan 19 toward the lower heater 22.

The lower heater 22 is disposed in the circulation duct 18 and is opposed to the rear portion 2*d* of the heating chamber 2. The lower heater 22 heats the air or the like flowing to the second and third rear outlets 30 and 31.

The circulation damper 23 is provided rotatably in the circulation duct 18 and between the middle heater 21 and the lower heater 22. The rotation of the circulation damper 23 is performed by a motor 59 for the circulation damper (referred to as "circulation damper motor 59" below) (shown in FIG. 5).

Moreover, the steam generating device 100 includes a metallic steam generating container 101 having an upper opening, a lid portion 102 made of a heat resistant resin for covering the upper opening of the steam generating container 101, and a steam generating heater 103 provided in the form of a sheath heater cast into a bottom portion 101*a* of the steam generating container 101 (see FIGS. 6 to 10A and 10B). Water supplied from the water supply tank 26 is accumulated on the bottom portion 101*a* of the steam generating container 101 and the steam generating heater 103, which is an example of a heat source, heats the water through the steam generating container 101. Then, saturated steam generated by heating by the steam generating heater 103 flows through a steam tube 35 formed of resin and a metallic steam pipe 36 and is thus supplied into the heating chamber 2 through a plurality of steam supply ports 37 (see FIG. 2). FIG. 3 shows only one of the steam supply ports 37.

The saturated steam in the heating chamber 2 is fed to the upper heater 20, the middle heater 21 and the lower heater 22 by the circulation fan 19 so that overheated steam at 100° C. or more is obtained by heating with the upper heater 20, the middle heater 21 and the lower heater 22.

A water level sensor 105 including a pair of electrodes 105*a* and 105*b* is attached to the lid portion 102. Based on whether a conduction state is brought between the electrodes 105*a* and 105*b* or not, it is decided whether a water level on the bottom portion 101*a* of the steam generating container 101 reaches a predetermined water level or not.

The tube pump 25 operates so that a water supply/discharge tube 40 made from silicone rubber or the like and elastically deformable is squeezed by a roller (not shown) to cause the water in the water supply tank 26 to flow to the steam generating device 100 or to cause the water in the steam generating device 100 to flow to the water supply tank 26, depending on a driving direction of the roller. The water supply/discharge tube 40 is an example of a water supply path.

The water supply tank 26 has a water supply tank body 41 and a communicating pipe 42. The communicating pipe 42 has one of ends positioned in the water supply tank body 41, while has the other end of the communicating pipe 42 positioned on the outside of the water supply tank 26. When the water supply tank 26 is accommodated in the tank cover 43, the other end of the communicating pipe 42 is connected to the water supply/discharge tube 40 through a tank joint portion 44. In other words, the inside of the water supply tank body 41 communicates with the inside of the steam generating device 100 through the communicating pipe 42 or the like.

The tube pump 25, the water supply tank 26, the water supply/discharge tube 40, the tank cover 43 and the tank joint portion 44 constitute a water supply device.

Figure 4:
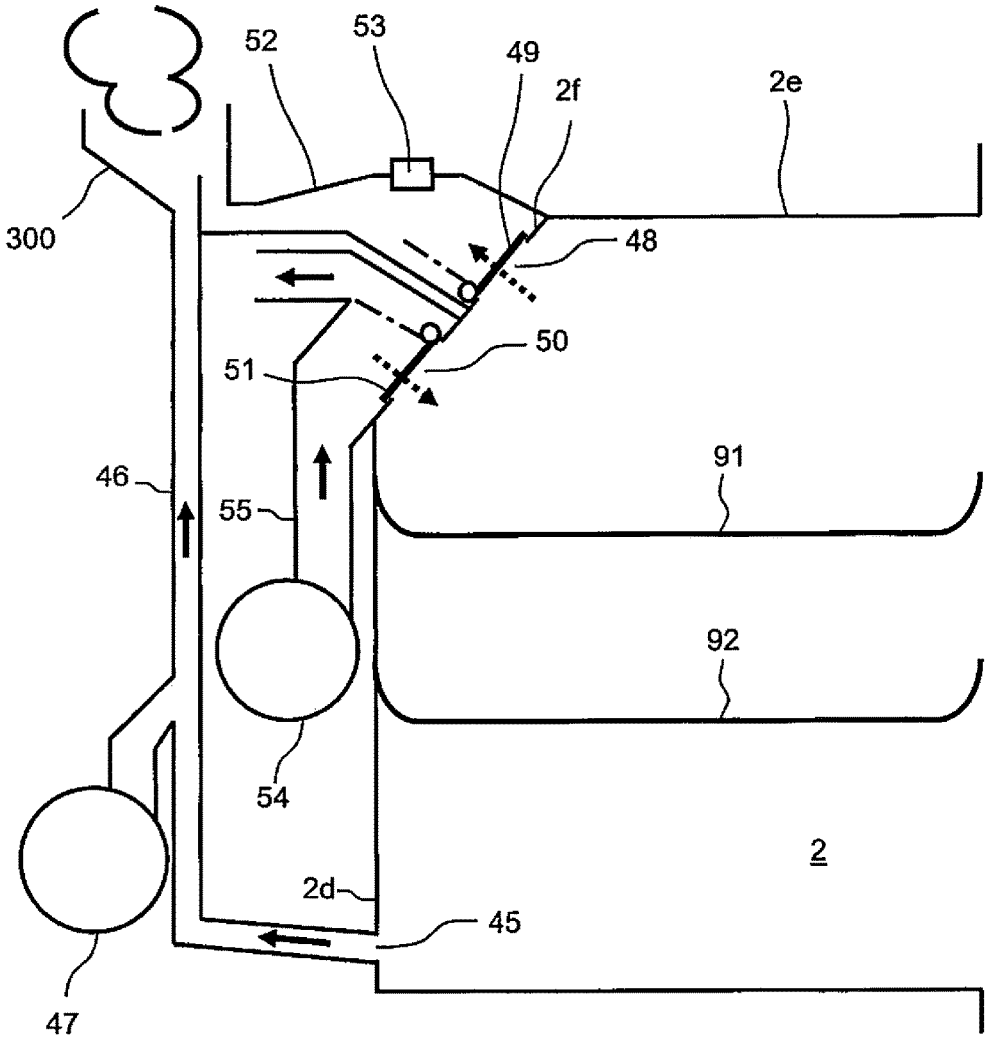
FIG. 4 is a schematic diagram for illustrating a configuration of other parts of the heat cooking device.

FIG. 4 is a schematic view for explaining a structure of other portions of the heat cooking device. FIG. 4 also shows a state in which the heating chamber 2 is seen from a right side, as with FIG. 3. In FIG. 4, components identical with the components in FIG. 3 are denoted by the same reference numerals.

A natural exhaust port 45 is provided on a lower end of the rear portion 2*d* of the heating chamber 2 (see FIG. 2). The natural exhaust port 45 communicates with the exhaust duct 300 through a first exhaust path 46. When the air or the like in the heating chamber 2 is excessive, the excessive air or the like naturally flows out of the natural exhaust port 45 to the first exhaust path 46. Moreover, an exhaust fan 47 provided in the form of a sirocco fan is connected to the first exhaust path 46, for example.

The inclined portion 2*f* of the heating chamber 2 is provided with a plurality of forcible exhaust ports 48 to be opened/closed by an exhaust damper 49 and a plurality of air supply ports 50 to be opened/closed by an air supply damper 51 (see FIG. 2). The forcible exhaust ports 48 communicate with the exhaust duct 5 through a second exhaust path 52. On the other hand, the air supply port 50 communicates with a space between the body casing 1 and the heating chamber 2 through the air supply path 55. Furthermore, an air supply fan 54 provided in the form of a sirocco fan, for example, is connected to an air supply path 55. The air supply fan 54 is an example of a cooling fan for cooling electrical components in the body casing 1 (shown in FIGS. 1 and 2).

Moreover, a steam sensor 53 is attached to the second exhaust path 52. The steam sensor 53 sends, to a control unit 120 (shown in FIG. 5), a signal indicative of an amount of steam contained in the air or the like flowing through the second exhaust path 52.

In the case in which the air or the like in the heating chamber 2 is forcibly discharged to the outside of the body casing 1, the exhaust damper 49 and the air supply damper 51 are rotated to positions shown in one-dotted chain lines by a motor 60 for the exhaust damper (referred to as "exhaust damper motor 60" below) and a motor 61 for the air supply damper (referred to as "air supply damper motor 61" below) (shown in FIG. 5), respectively. In other words, the exhaust damper 49 and the air supply damper 51 are opened. Then, the exhaust fan 47 and the air supply fan 54 are driven by a motor 57 for the exhaust fan (referred to as "exhaust fan motor 57" below) and a motor 58 for the air supply fan (referred to as "air supply fan motor 58" below) (shown in FIG. 5). Consequently, the air or the like in the heating chamber 2 is drawn out of the forcible exhaust ports 48 and the natural exhaust port 45 to the outside of the heating chamber 2.

For cooling the magnetron 4 (shown in FIG. 5) or the like between the body casing 1 and the heating chamber 2, the air supply fan 54 is driven in a state in which the air supply damper 51 is closed. Consequently, the air blown out of the air supply fan 54 through the air supply path 55 cools electrical components such as the magnetron 4 disposed in a space between the body casing 1 and the heating chamber 2.

Figure 5:
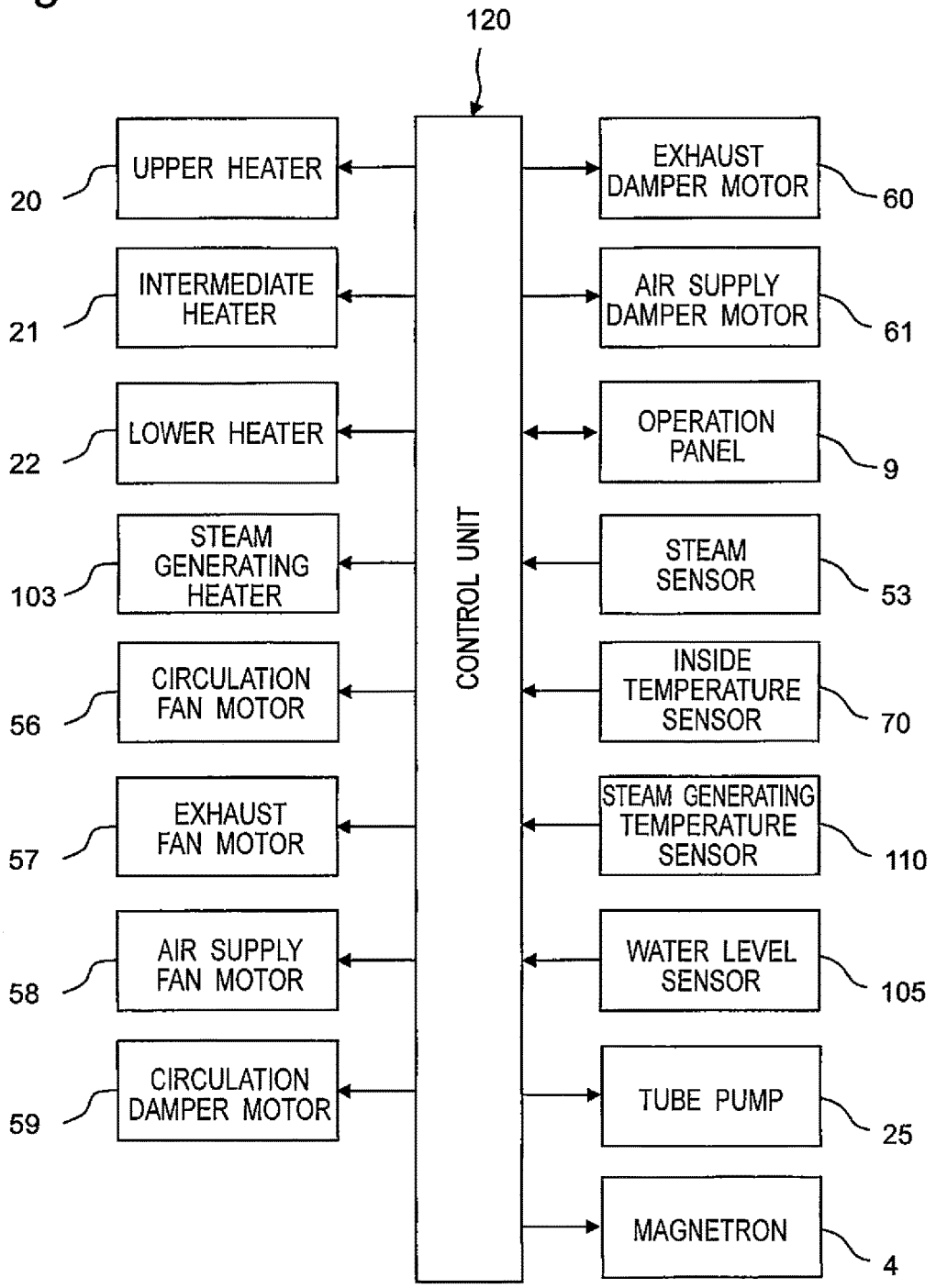
FIG. 5 is a control block diagram of the heat cooking device.

FIG. 5 is a control block diagram showing the heat cooking device.

As shown in FIG. 5, the heating cooker includes a control device 120 composed of microcomputers, input/output circuits, and the like. Connected to the control device 120 are the upper heater 20, the intermediate heater 21, the lower heater 22, the steam generating heater 103, the circulation fan motor 56, the exhaust fan motor 57, the air supply fan motor 58, the circulation fan motor 59, the exhaust damper motor 60, the air supply damper motor 61, the operation panel 9, the steam sensor 53, an inside temperature sensor 70, a steam generating temperature sensor 110, the water level sensor 105, the tube pump 25, the magnetron 4, and the like. On basis of a signal from the operation panel 9 and detection signals from the steam sensor 53, the inside temperature sensor 70, the steam generating temperature sensor 110, and the water level sensor 105, the control device 120 controls the upper heater 20, the intermediate heater 21, the lower heater 22, the steam generating heater 103, the circulation fan motor 56, the exhaust fan motor 57, the air supply fan motor 58, the circulation fan motor 59, the exhaust damper motor 60, the air supply damper motor 61, the tube pump 25, the magnetron 4, and the like.

Figure 6:
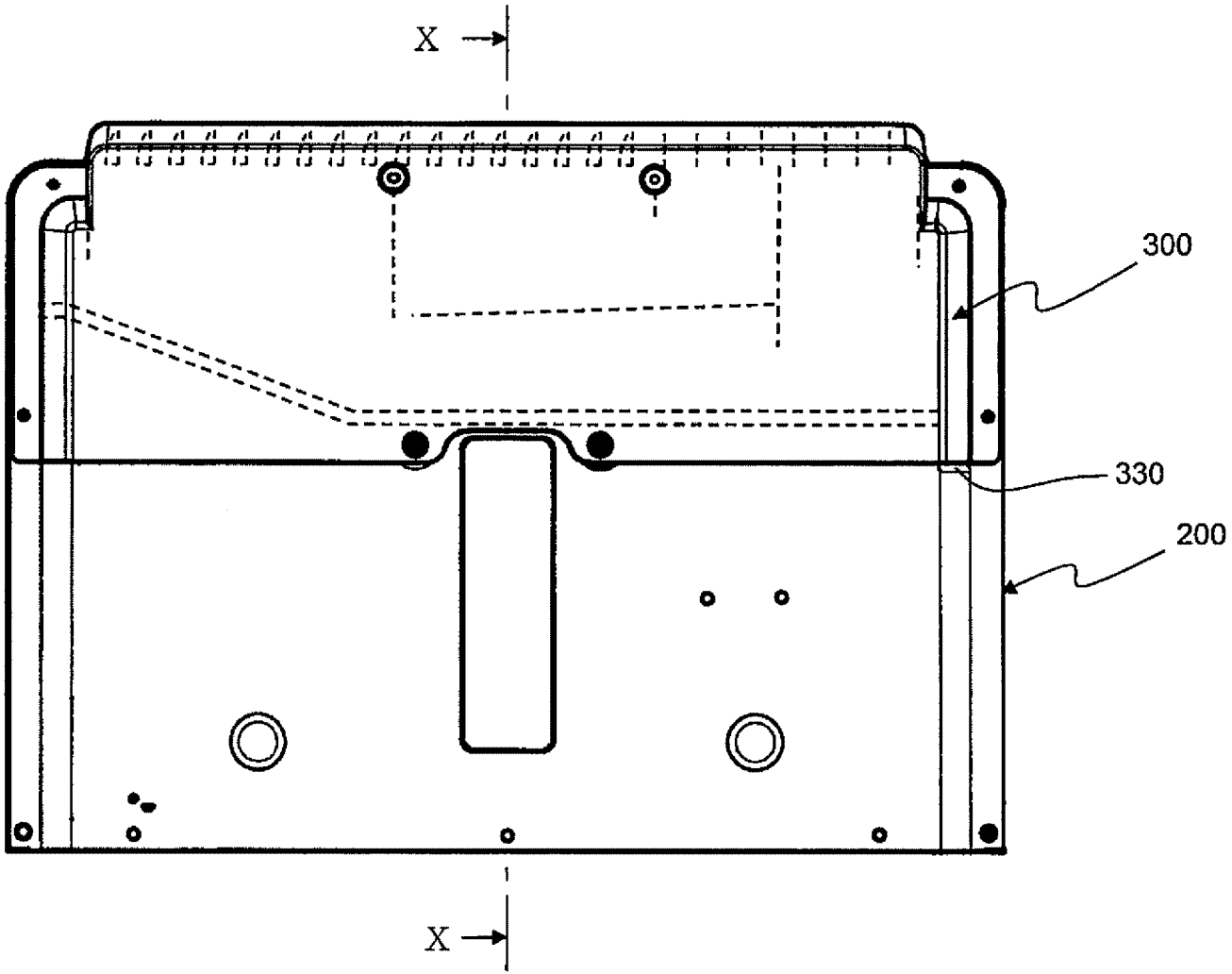
FIG. 6 is a rear view of the heat cooking device.

FIG. 6 is a rear view of the heat cooking device. As illustrated in FIG. 6, an upper outer wall surface of a rear surface plate 200 of the casing 1 (illustrated in FIG. 1 and FIG. 2) is covered by the exhaust duct 300.

Figure 7A:
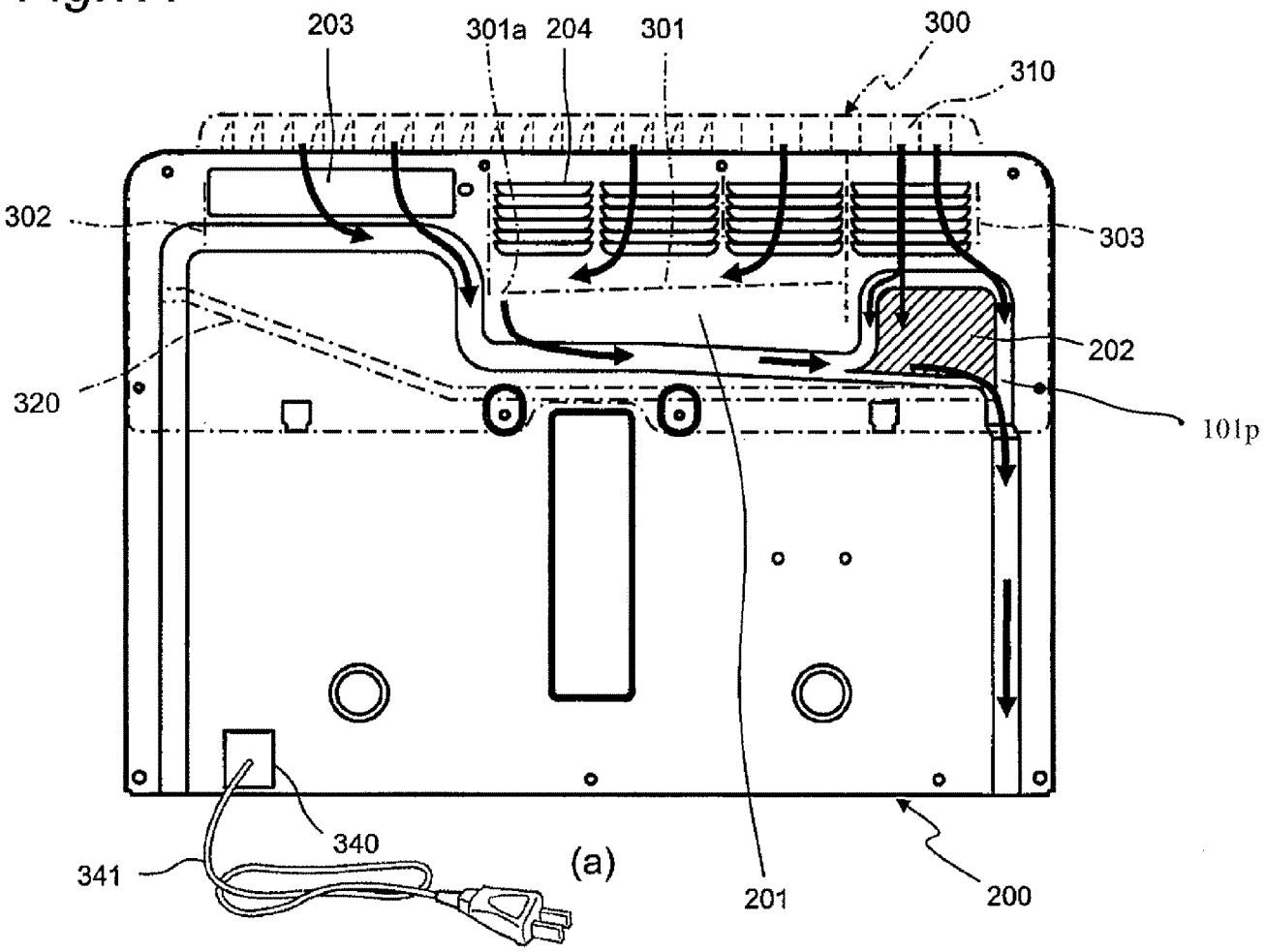
FIG. 7A is a diagram when a rear surface plate of the heat cooking device is viewed from the rear side.
Figure 7B:
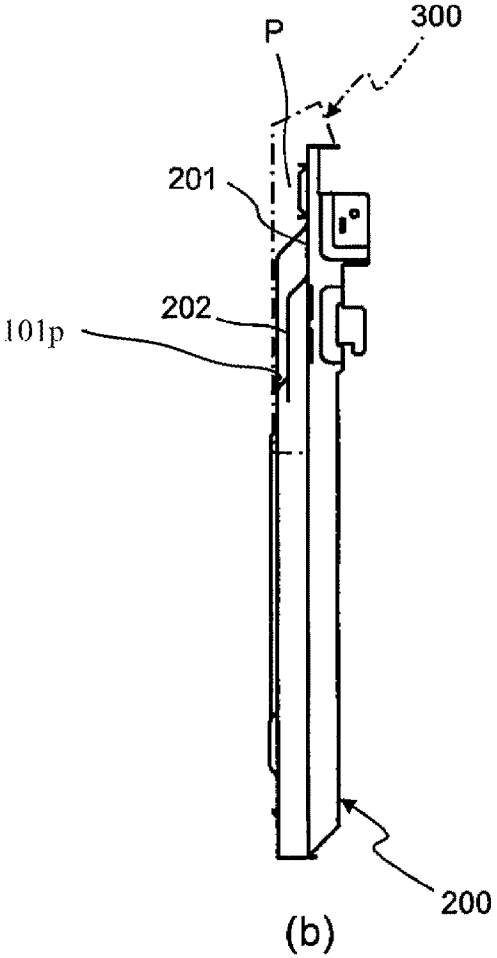
FIG. 7B is a diagram when the rear surface plate is viewed from the lateral side.

FIG. 7A is a diagram when the rear surface plate 200 is viewed from the rear side, and FIG. 7B is a diagram when the rear surface plate 200 is viewed from the lateral side. As illustrated in FIG. 7A and FIG. 7B, on the upper side of the rear surface plate 200 of the casing 1 (illustrated in FIG. 1 and FIG. 2), a stepped part 201 as an example of a recess that is recessed on the front surface side is provided. This stepped part 201 is covered by the exhaust duct 300, so that an outer wall surface of the exhaust duct 300 is located on the same plane as an outer wall surface below the stepped part 201, in an outer wall surface of the rear surface plate 200.

Consequently, the rear surface of the casing 1 can be closely installed on a wall surface of an installation place.

The upper outer wall surface of the rear surface plate 200 of the casing 1 is covered by the exhaust duct 300, so that an exhaust passage P is formed between the casing 1 and the exhaust duct 300. The bottom portion 101*p* of this exhaust passage P is inclined obliquely downward in one of the right and left directions (right direction in FIG. 7A) of the casing 1.

In the stepped part 201 of the rear surface plate 200, a diluted exhaust air blow-out hole 203 having a rectangle shape that is long in the right-left direction, and cooling air blow-out holes 204 composed of a plurality of slots that are long in the right-left direction are provided from the left to the right in FIG. 7A.

The diluted exhaust air blow-out hole 203 and the cooling air blow-out holes 204 form exhaust air holes.

The diluted exhaust air blow-out hole 203 has both sides surrounded by a left side of a partition plate 301 and a partition plate 302.

In the cooling air blow-out holes 204, the first row to the fourth row, in which a plurality of slots whose longitudinal directions are horizontal are arrayed vertically, are disposed at intervals in the right-left direction. The first row to the third row of the cooling air blow-out holes 204, from the left end of FIG. 7A are surrounded by the partition plate 301 erected on an inner wall surface of the exhaust duct 300. This partition plate 301 prevents exhaust air blown out from the diluted exhaust air blow-out hole 203 from flowing back into the casing 1 from the cooling air blow-out holes 204. Additionally, the partition plate 301 has right and left side parts, and a bottom portion connecting lower ends of the side parts, and is provided with a cutout 301*a* at a left lower corner part. There is a possibility that the exhaust air blown out from the diluted exhaust air blow-out hole 203 flows back, to infiltrate into the cooling air blow-out holes 204 through the cutout 301*a*, but most of the exhaust air is guided by inclination becoming gradually higher from the left to the right of the bottom portion of the partition plate 301 to flow to an opposite side to the cutout 301*a*.

The cooling air blow-out holes 204 are provided with cut bent parts that are cut and bent upward from lower edges of a plurality of the slots to the inside of the casing 1. Consequently, a plurality of the slots of the cooling air blow-out holes 204 are open rearward and obliquely downward.

The fourth row of the cooling air blow-out holes 204, located at the right end of FIG. 7A, has both sides surrounded by a right side part of the partition plate 301 and the partition plate 302. Below the fourth row at the right end of the cooling air blow-out holes 204, a protrusion 202 (shaded region in FIG. 7A) that protrudes below the stepped part 201 is provided on the rear surface plate 200.

The partition plates 301 to 303, stepped part 201, and protrusion 202 form a guidance part. This guidance part (301 to 303, 201, 202) guides, along an outer wall of the rear surface plate 200 of the casing 1, water infiltrating into the exhaust passage P (illustrated in FIG. 7B) from an outlet 310 of the exhaust duct 300, as illustrated by thick arrows in FIG. 7A.

At this time, water infiltrating into a region surrounded by the partition plate 301 from the outlet 310 of the exhaust duct 300 flows along the bottom portion that is the lower side of the partition plate 301 and is inclined downward from the right toward the left of FIG. 7A, and thereafter flows out from the cutout 301*a* at the left lower corner part of the partition plate 301. After that, the water flowing out from the cutout 301*a* flows along the wall surface (bottom portion 101*p* of the exhaust passage P) that forms a level difference of the stepped part 201 and is inclined from the left to the right. The cutout 301*a* is provided at the lower end of the inclined bottom portion of the partition plate 301, so that water flows out at a higher position of the bottom portion 101*p* of the exhaust passage P, the force of the water flowing on the bottom portion 101*p* of the exhaust passage P can be strengthened, and is easily discharged. Herein, the protrusion 202 may not be provided. In this case, a flow passage through which water on the bottom portion 101*p* of the exhaust passage P flows is not narrowed in the middle, and therefore the force of the water flowing on the bottom portion 101*p* of the exhaust passage P is not weakened, and is more easily to be discharged.

In the heat cooking device, a power cord connection part 340 to which a power cord 341 is connected is provided on the left lower side of the rear surface plate 200 of the casing 1. The water infiltrating into the exhaust passage P from the outlet 310 of the exhaust duct 300 is guided to be allowed to escape in the direction opposite to the power cord connection part 340 located on the left (right in FIG. 7A) by the guidance part (301 to 303, 201, 202) so as not to splash the power cord connection part 340.

The outer wall surface of the exhaust duct 300 may be located in front of the outer wall surface below the stepped part 201, in the outer wall surface of the rear surface plate 200 of the casing 1. Also in this case, similarly to the configuration illustrated in FIG. 7A and FIG. 7B, the rear surface of the casing 1 can be closely installed on the wall surface of the installation place.

Figure 8A:
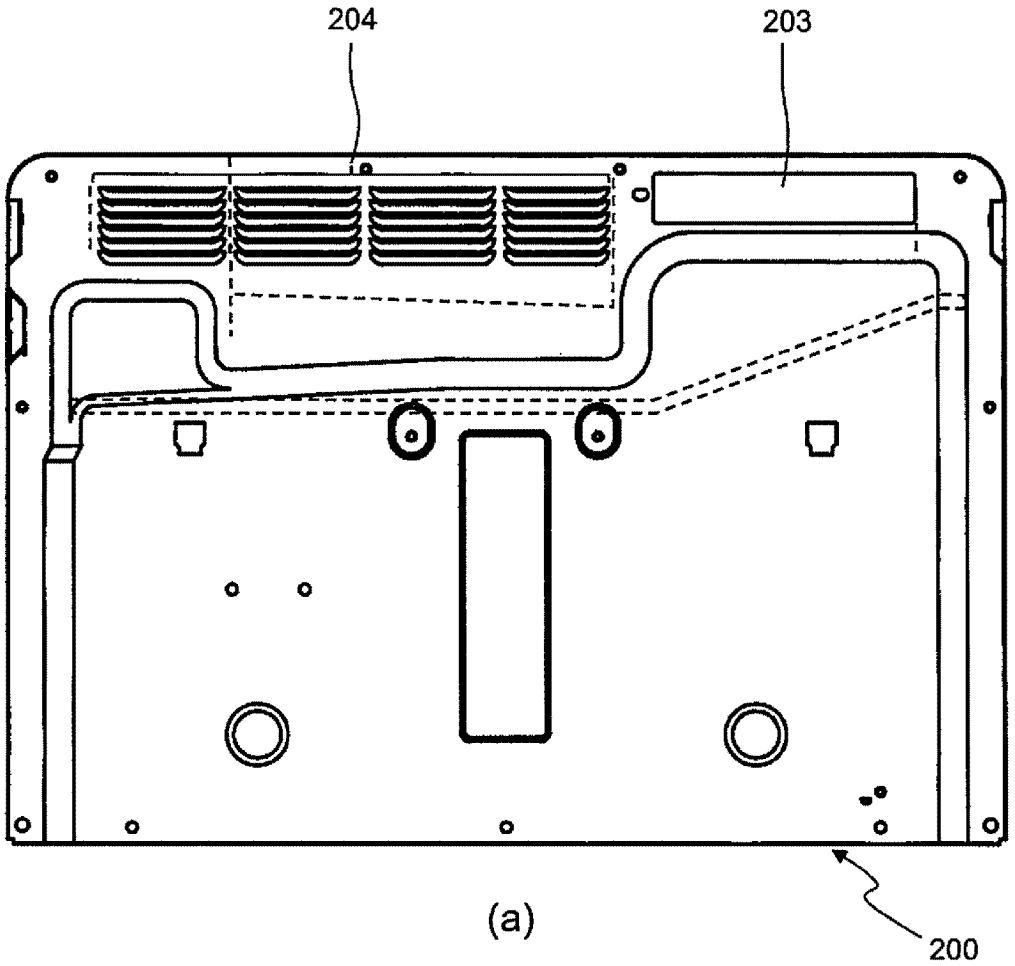
FIG. 8A is a diagram when the rear surface plate of the heat cooking device is viewed from the front surface side.
Figure 8B:
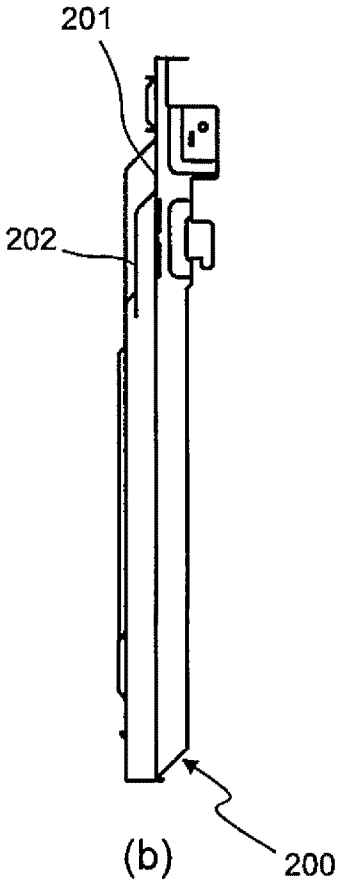
FIG. 8B is a diagram when the rear surface plate is viewed from the lateral side.

FIG. 8A is a diagram when the rear surface plate 200 is viewed from the front surface side (the inside of the casing 1), and FIG. 8B is a diagram when the rear surface plate 200 is viewed from the lateral side. In FIG. 8A and FIG. 8B, components identical with the components in FIG. 7A and FIG. 7B are denoted by the same reference numerals.

The rear surface plate 200 of the casing 1 illustrated in FIG. 7A, FIG. 7B, FIG. 8A and FIG. 8B is provided separately from the upper surface plate, a side surface plate, and a bottom portion surface plate. However, the rear surface plate of the casing may be formed integrally with the upper surface plate, or the side surface plate, or the like.

Figure 9A:
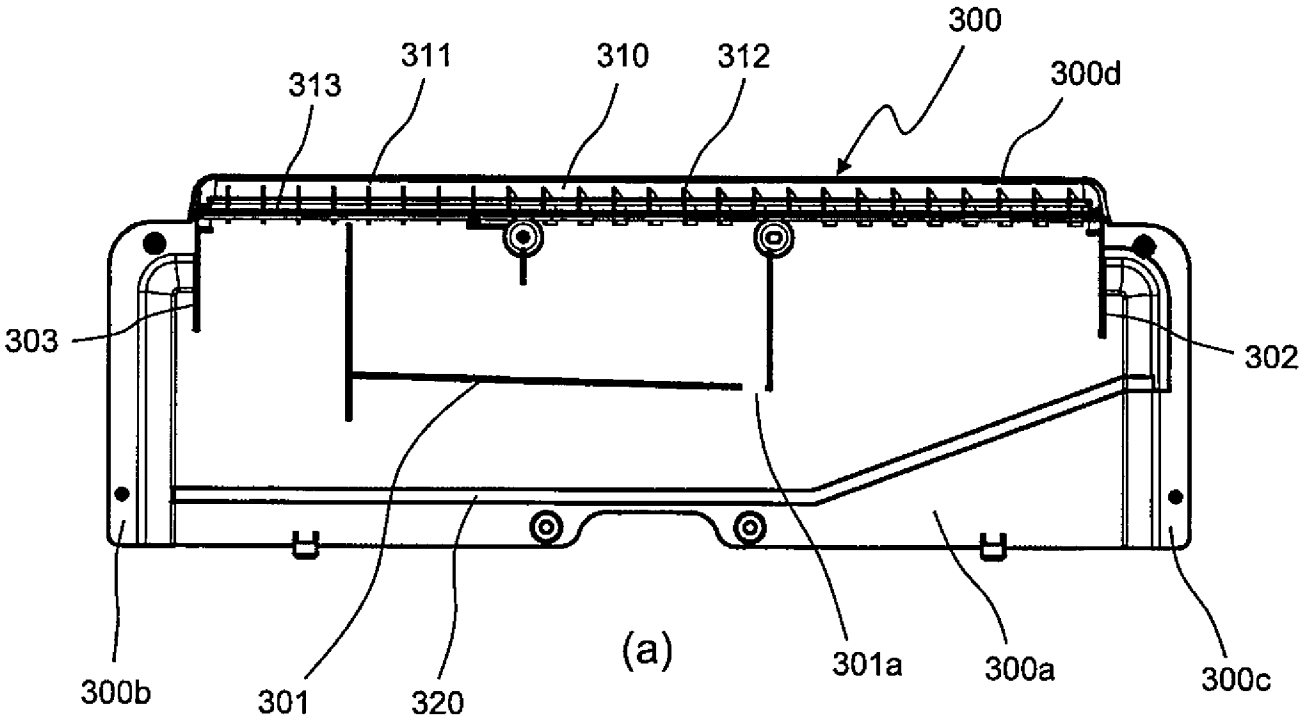
FIG. 9A is a diagram when an exhaust duct covering the rear surface plate is viewed from a rear side.
Figure 9B:
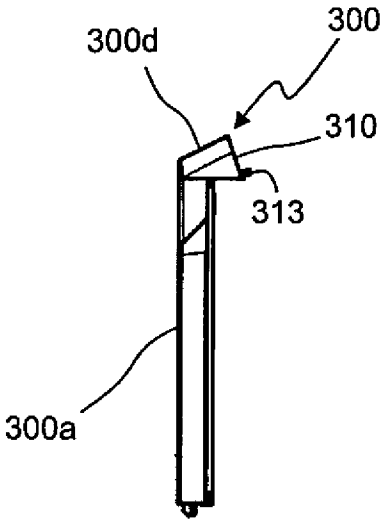
FIG. 9B is a diagram when the exhaust duct is viewed from the lateral side.

FIG. 9A is a diagram when the exhaust duct 300 is viewed from the rear side, and FIG. 9B is a diagram when the exhaust duct 300 is viewed from the lateral side. In FIG. 9A and FIG. 9B, components identical with the components in FIG. 7A and FIG. 7B are denoted by the same reference numerals.

As illustrated in FIG. 9A, FIG. 9B, the exhaust duct 300 has a rectangular base 300*a*, curved parts 300*b*, 300*c* provided in both ends in the longitudinal direction of the base 300*a*, and a hood part 300*d* provided on the upper side of the base 300*a* so as to be bent forward. This hood part 300*d* forms the outlet 310 that is open forward.

A rib 313 is provided so as to protrude obliquely upward from the lower side of the outlet 310 of the exhaust duct 300. This rib 313 is provided in the right-left direction of the casing 1.

The exhaust duct 300 is integrally formed by resin molding.

Inside the hood part 300*d* of the exhaust duct 300, a plurality of wind direction control blades 311 that control the wind direction such that air is blown out forward from the outlet 310 are provided in a left region of substantially ⅓ of a width in the right-left direction in front view. Additionally, inside the hood part 300*d* of the exhaust duct 300, a plurality of wind direction control blades 312 that control the wind direction such that air is blown out forward from the outlet 310 in the obliquely lateral direction are provided in a right region of substantially ⅔ of the width in the right-left direction in front view.

On the lower side of the inner wall surface of the exhaust duct 300, a seal member 320 is adhered. This seal member 320 seals the rear surface plate 200 and the exhaust duct 300, as illustrated in FIG. 7A.

Figure 10A:
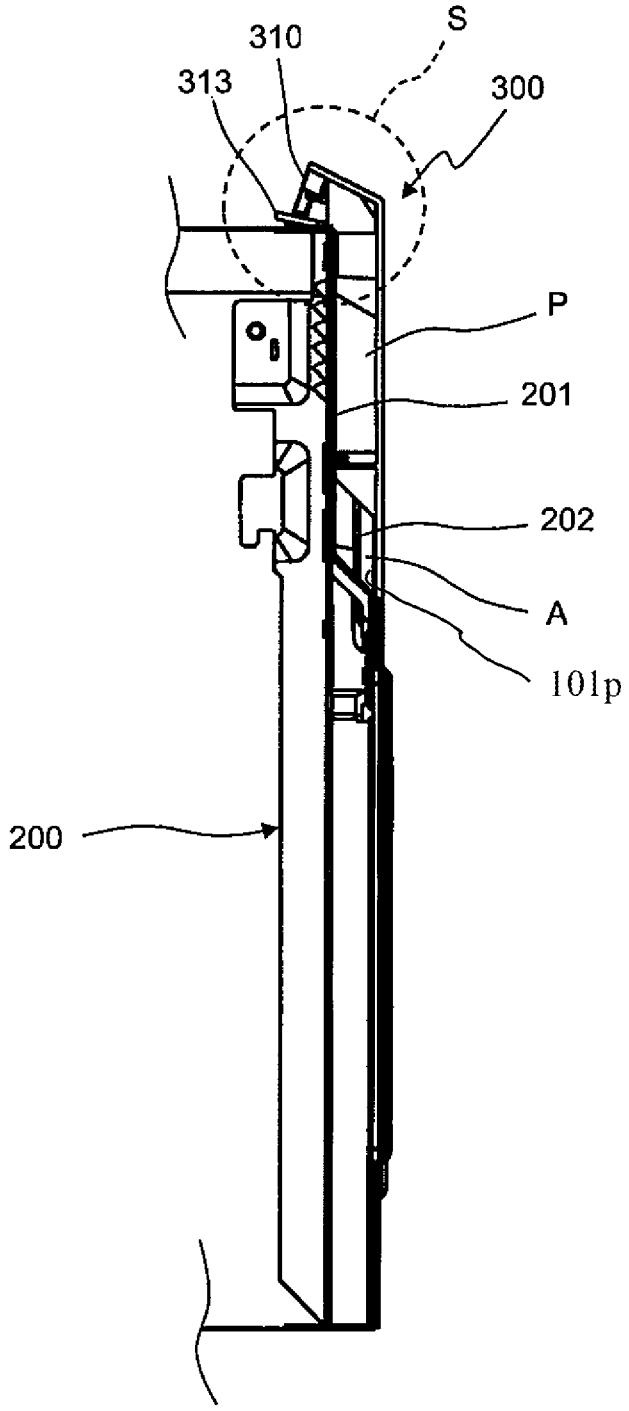
FIG. 10A is a sectional view of principal parts as viewed from a line X-X of FIG. 6.
Figure 10B:
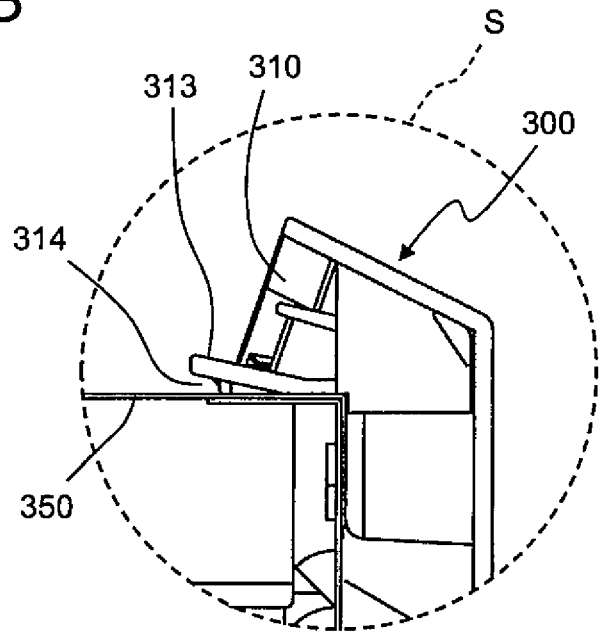
FIG. 10B is an enlarged view of a region S of FIG. 10A.

FIG. 10A is a sectional view of principal parts as viewed from a line X-X of FIG. 6, and FIG. 10B is an enlarged view of a region S of FIG. 10A.

As illustrated in FIG. 10A, the exhaust passage P is formed between the rear surface plate 200 and the inner wall surface of the exhaust duct 300. As illustrated by the arrows in FIG. 7A, the water infiltrating into the exhaust passage P from the outlet 310 of the exhaust duct 300 is guided downward along the outer wall of the rear surface plate 200 of the casing 1 by the guidance part ((301 to 303, 201, 202 illustrated in FIG. 7A) provided in the exhaust passage P.

Consequently, for example, even when a glass with 500 ml of water therein being placed on an upper surface of the casing 1 accidentally spills on the upper surface of the casing 1, the spilled water can be prevented from infiltrating into the casing 1 through the outlet 310 of the exhaust duct 300.

As illustrated in FIG. 10A, the protrusion 202 (shaded region in FIG. 7A) may be provided in the stepped part 201 of the rear surface plate 200, and a gap A may be formed between the protrusion 202 and the inner wall surface of the exhaust duct 300. A gap of the bottom portion 101*p* of the exhaust passage P is narrowed in the middle by this gap A, and therefore the water infiltrating into the exhaust passage P from the outlet 310 of the exhaust duct 300 can travel through the wall surface of the casing 1 to flow downward without bursting out.

As illustrated in the enlarged view (region S) of FIG. 10B, a groove 314 is formed between the upper surface plate 350 of the casing 1 and the rib 313 provided on the lower side of the outlet 310 of the exhaust duct 300 in the right-left direction of the casing 1.

Figure 11:
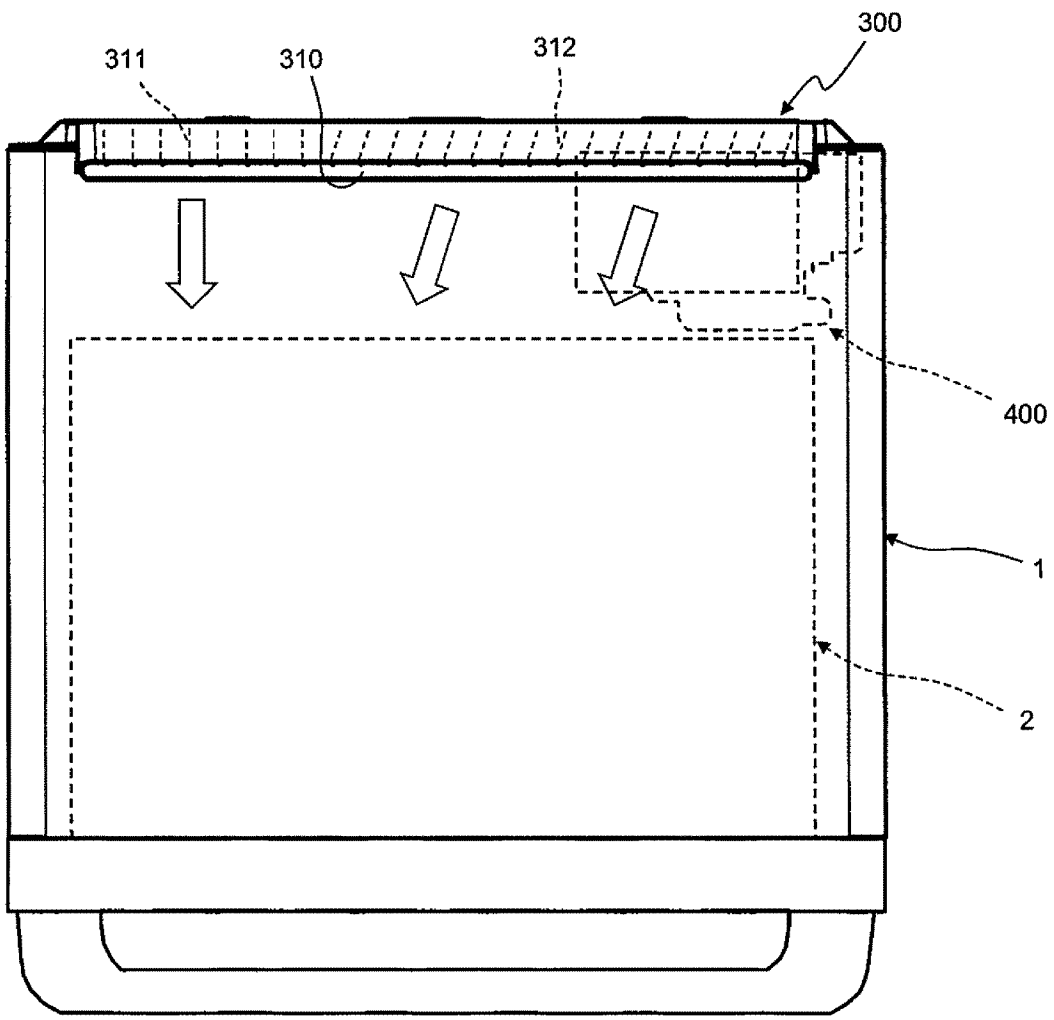
FIG. 11 is a top view of the heat cooking device.

FIG. 11 is a top view of the heat cooking device. As illustrated in FIG. 11, air blown out from the outlet 310 of the exhaust duct 300 mounted on the rear surface side of the casing 1 is blown out forward by the plurality of wind direction control blades 311 arrayed on the left, and is blown out forward in the obliquely left direction by the plurality of wind direction control blades 312 arrayed on the right . At this time, exhaust air from the inside of the heating chamber 2, which is diluted in an exhaust air unit 400, is blown out from the right of the outlet 310 of the exhaust duct 300.

This exhaust air unit 400 has the exhaust fan 47, the forcible exhaust port 48, and the natural exhaust port 45 illustrated in FIG. 4.

As described with reference to FIG. 4, the exhaust fan 47 and the air supply fan 54 are driven, so that air and the like inside the heating chamber 2 are drawn out from the forcible exhaust port 48 and the natural exhaust port 45 to the outside of the heating chamber 2 through the exhaust duct 300.

Figure 12:
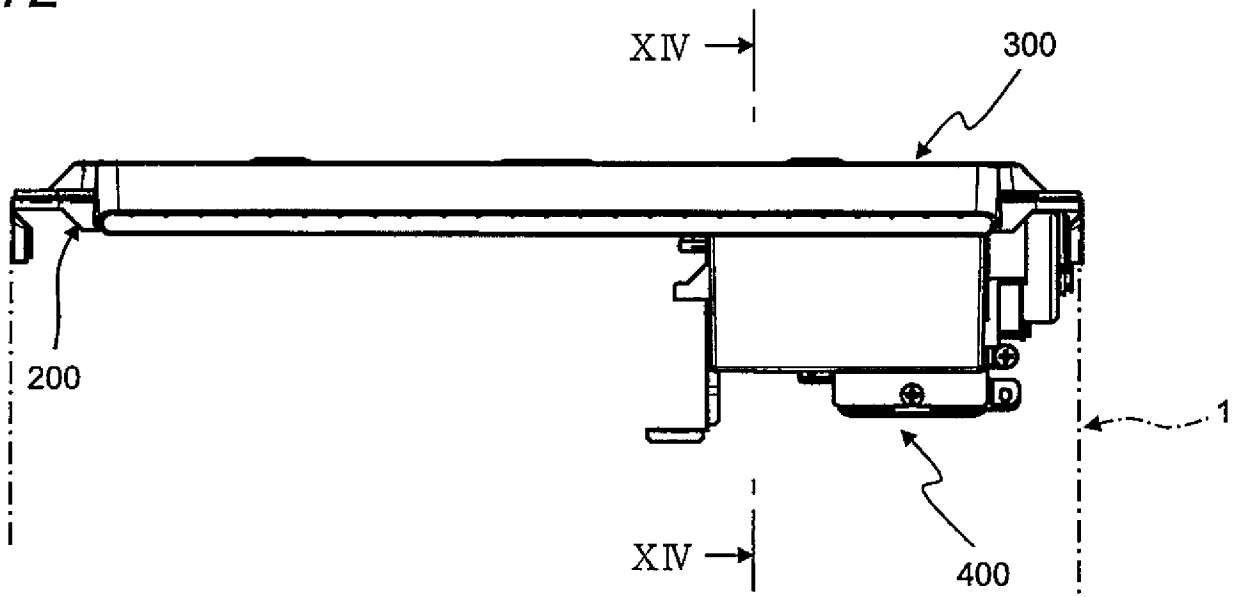
FIG. 12 is a top view of principal parts including the rear surface plate of the heat cooking device.
Figure 13:
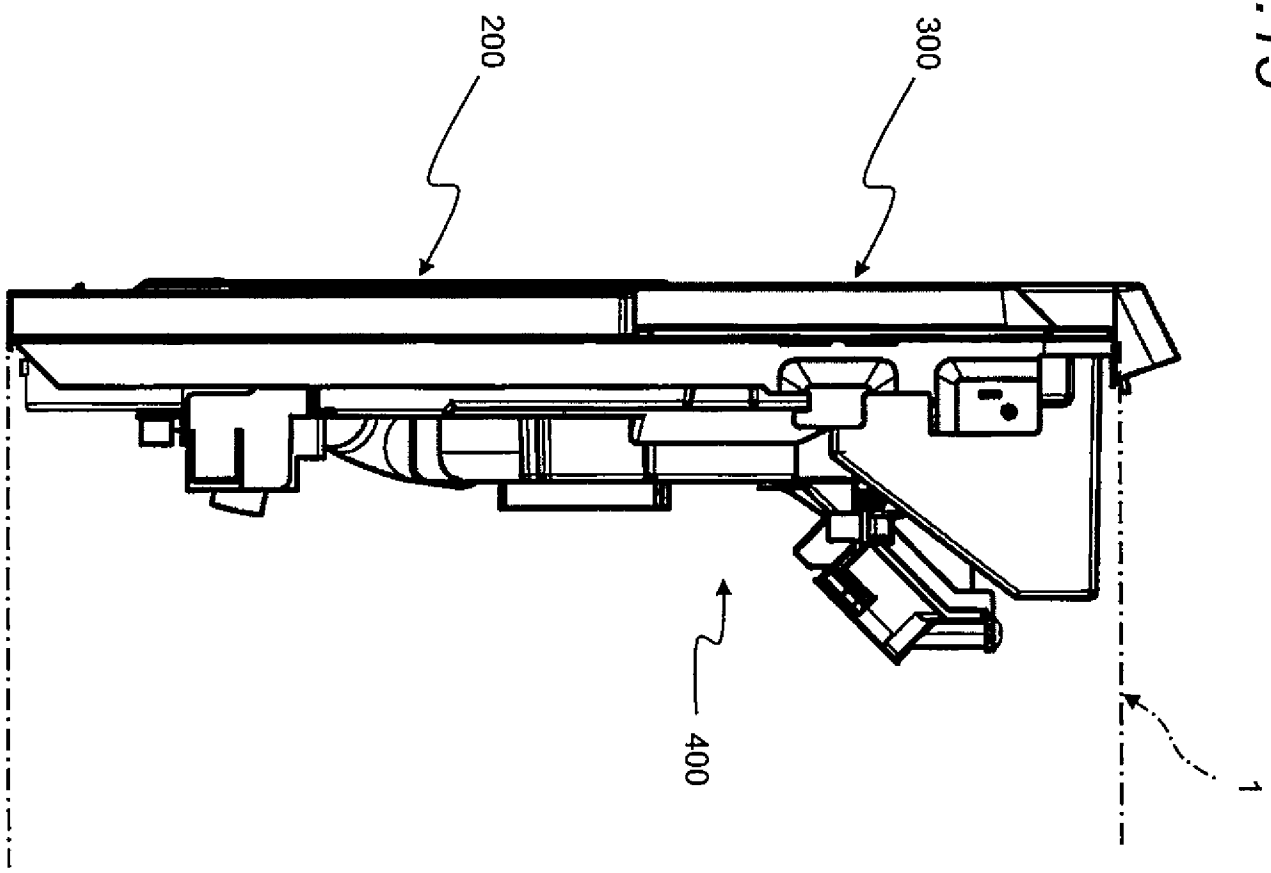
FIG. 13 is a side view of the principal parts including the rear surface plate of the heat cooking device.

FIG. 12 is a top view of principal parts including the rear surface plate 200 of the heat cooking device, and FIG. 13 is a side view of the principal parts including the rear surface plate 200 of the heat cooking device. As illustrated in FIG. 12 and FIG. 13, the exhaust air unit 400 is mounted on the front surface side of the rear surface plate 200 mounted with the exhaust duct 300.

Figure 14:
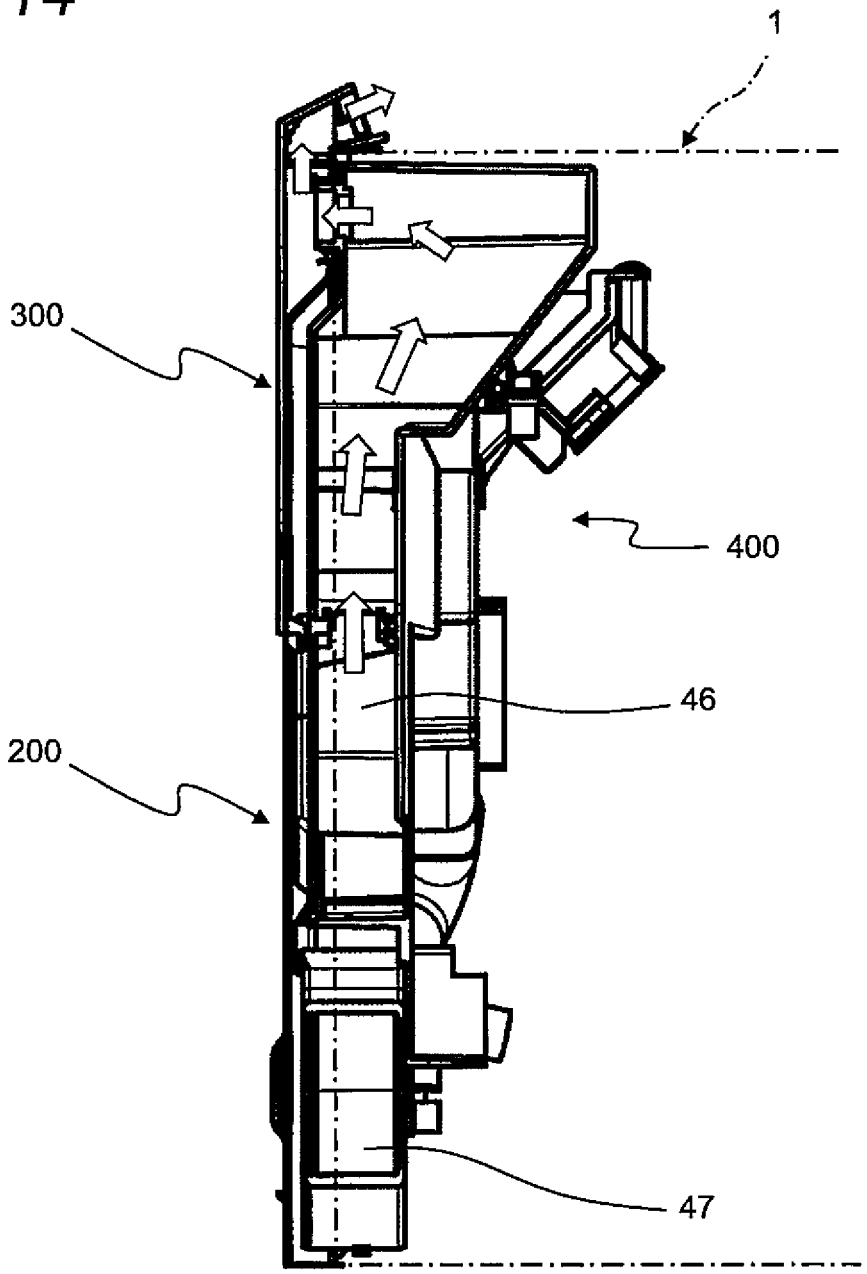
FIG. 14 is a sectional view as viewed from a line XIV-XIV of FIG. 12.

FIG. 14 is a sectional view as viewed from a line XIV-XIV of FIG. 12, and components identical with the components in FIG. 7A and FIG. 7B are denoted by the same reference numerals.

As illustrated in FIG. 14, in the exhaust air unit 400, air and the like inside the heating chamber 2 (illustrated in FIG. 1 and FIG. 2) are sent out toward the exhaust duct 300 through the first exhaust path 46 by the exhaust fan 47.

According to the heat cooking device having the configuration, the upper outer wall surface of the rear surface plate 200 of the casing 1 is covered by the exhaust duct 300, so that the exhaust passage P is formed between the casing 1 and the exhaust duct 300, the bottom portion 101*p* of the exhaust passage P is inclined obliquely downward in one of the right and left directions of the casing 1, and an opening portion 330 (illustrated in FIG. 6) is provided between the rear surface plate 200 of the casing 1 and the exhaust duct 300 on a lower side of the bottom portion 101*p* of the exhaust passage P. Consequently, water infiltrating into the exhaust passage P from the upper surface side of the casing 1 through the outlet 310 of the exhaust duct 300 is guided obliquely downward along the inclined bottom portion 101*p* of the exhaust passage P, and exhausted from the opening portion 330 provided between the rear surface plate 200 of the casing 1 and the exhaust duct 300 on the lower side of the bottom portion 101*p* of the exhaust passage P. Therefore, even when water wrongly overflows on the upper surface of the casing 1, the water that has overflown can be prevented from infiltrating into the casing 1 through the outlet 310 of the exhaust duct 300.

The water infiltrating into the exhaust passage P is guided downward along the outer wall of the rear surface plate 200 of the casing 1 by the guidance part including the partition plates 301 to 303 erected on the inner wall surface of the exhaust duct 300. Therefore, when the exhaust duct 300 is resin-molded, the partition plates 301 to 303 can be formed at the same time, and the guidance part can be formed with a simple configuration. The guidance part may include a partition plate erected on the outer wall surface of the rear surface plate 200 of the casing 1.

The stepped part 201 and the protrusion 202 provided on the rear surface plate 200 of the casing 1 guides, downward along the outer wall of the rear surface plate 200 of the casing 1, the water infiltrating into the exhaust passage P, and therefore the guidance part can be formed with a simple configuration in which the rear surface plate 200 of the casing 1 is subjected to rugged working.

The stepped part 201 provided on the upper side of the rear surface plate 200 of the casing 1 is formed to be recessed forward, and the outer wall surface of the exhaust duct 300 is located on the same plane as the outer wall surface below the stepped part 201, in the outer wall surface of the rear surface plate 200 of the casing 1 in a state where the stepped part 201 is covered by the exhaust duct 300, so that the rear surface of the casing 1 can be closely installed on the wall surface of the installation place.

The outer wall surface of the exhaust duct 300 may be located in front of the outer wall surface below the stepped part 201, in the outer wall surface of the rear surface plate 200 of the casing 1. In this case, the rear surface of the casing 1 can be closely installed on the wall surface of the installation place similarly.

The exhaust air holes (203, 204) that allow exhaust air from the inside of the casing 1 to blow out toward the exhaust passage P are provided on the upper side of the rear surface plate 200 of the casing 1 so as to be open rearward in the horizontal direction or in the obliquely downward direction, so that while the water infiltrating into the exhaust passage P from the upper surface side of the casing 1 through the outlet 310 of the exhaust duct 300 is prevented from flowing downward to flow into the casing 1 from the exhaust air holes (203, 204), the exhaust air from the inside of the casing 1 can be blown out from the outlet 310 of the exhaust duct 300 to the outside through the exhaust air holes (203, 204) and the exhaust passage P.

Apart of the water that has overflown on the upper surface of the casing 1 is drawn back by the rib 313 provided on the lower side of the outlet 310, and a part of the water that has overflown on the upper surface of the casing 1 is allowed to escape in the right-left direction by the groove 314 formed in the right-left direction of the casing 1, and therefore it is possible to reduce the amount of the water infiltrating into the exhaust passage P from the outlet 310.

Steam contained in the exhaust air blown out from the outlet 310 of the exhaust duct 300 hardly comes into contact with the upper surface of the casing 1 by the rib 313, and it is possible to suppress generation of dew condensation on the upper surface of the casing 1.

In the first embodiment, the upper outer wall surface of the rear surface plate 200 of the casing 1 is covered by the exhaust duct 300, so that the exhaust passage P is formed between the casing 1 and the exhaust duct 300. However, the shapes of the rear surface plate of the casing and the exhaust duct are not limited to the, and may be suitably set in accordance with the casing, the inner configuration of the casing, and the like.

[Second Embodiment]

Figure 15:
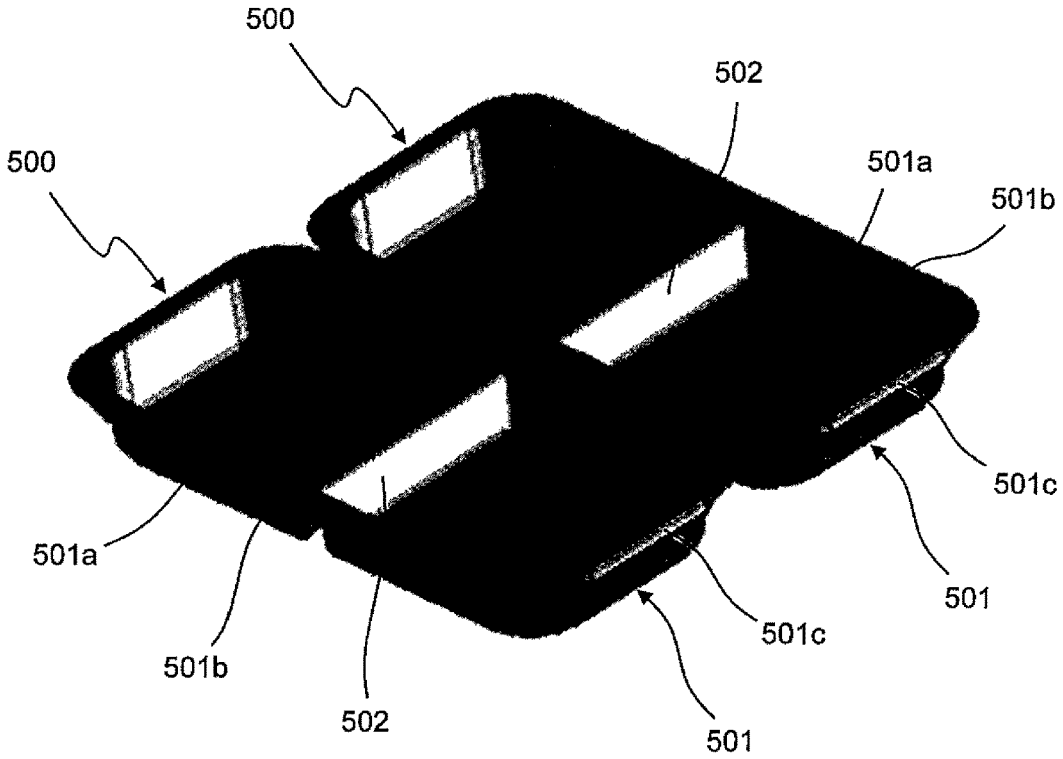
FIG. 15 is a perspective view of a cooking tray used in a heat cooking device of a second embodiment of the present invention.

FIG. 15 is a perspective view of cooking trays 500 used in a heat cooking device of a second embodiment of the present invention. The heat cooking device of this second embodiment has the same configuration of the heat cooking device of the first embodiment except the cooking trays 500.

As illustrated in FIG. 15, the cooking trays 500 of the heat cooking device of this second embodiment each have a rectangular cooking tray base 501 in plan view, and a partition wall 502 that divides the inside of the cooking tray base 501 into two portions. This cooking tray base 501 has a rectangular bottom portion 501*a* in plan view, a side part 501*b* surrounding a peripheral edge of the bottom portion 501*a*, and a flange part 501c extending outward from a whole periphery of an upper end of the side part 501*b*.

The cooking trays 500 are disposed in two rows in the front-rear direction while the flange parts 501c at both sides in the longitudinal directions of the cooking trays 500 are supported by upper shelf receivers 16A, 16B (illustrated in FIG. 2). The cooking trays 500 may be disposed in two rows in the front-rear direction while being supported by lower shelf receivers 17A, 17B.

In the heat cooking device of this second embodiment, the two cooking trays 500 are placed on a pair of the upper shelf receivers 16A, 16B (or the lower shelf receivers 17A, 17B), and heating cooking can be performed at the same time.

The two cooking trays 500 are used in place of dishes after cooking, thereby improving convenience. In this second embodiment, the two cooking trays 500 are placed on a pair of the upper shelf receivers 16A, 16B (or the lower shelf receivers 17A, 17B). However, the cooking trays may be formed such that three or more cooking trays can be disposed on the pair of shelf receivers.

The inside of each cooking tray 500 is divided into two portions by the partition wall 502, so that a plurality of cooking can be performed by one cooking tray at the same time. In this second embodiment, the inside of each cooking tray 500 is divided into two portions by the partition wall 502. However, the configuration of the partition wall is not limited to this, and a partition wall that divides the inside of a cooking tray into three, or four or more portions may be provided.

Furthermore, in the heat cooking device of the second embodiment, the size of the one cooking tray 500 is smaller than the size of a conventional cooking tray, and it is possible to facilitate storage when the cooking tray is not used, and cleanup.

[Third Embodiment]

Figure 16:
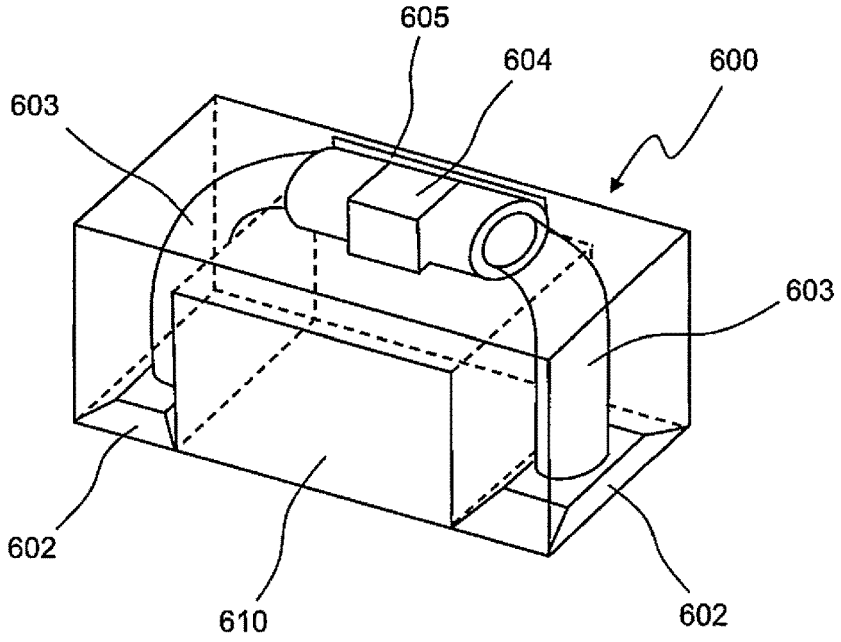
FIG. 16 is a schematic diagram of a heat cooking device of a third embodiment of the present invention, as viewed obliquely from above

FIG. 16 is a schematic diagram of a heat cooking device 600 of a third embodiment of the present invention, as viewed obliquely from above. This heat cooking device 600 is a suspension type ventilating fan cum microwave oven.

As illustrated in FIG. 16, the heat cooking device 600 of this third embodiment has a rectangular parallelepiped casing 601 that houses a microwave oven body 610, suction ports 602, 602 for ventilation that are provided on a lower surface on right and left both sides of the microwave oven body 610 in the casing 601, flexible ducts 603, 603 that are disposed inside the casing 601, and have lower ends connected to the respective suction ports 602, 602 for ventilation, a fan 604 for exhaust that is provided on the upper side of the microwave oven body 610 inside the casing 601, and have suction ports (not illustrated) connected to respective upper ends of the flexible ducts 603, 603, a ventilation port 605 that is provided on the rear surface side of the casing 601, and connected to an outlet (not illustrated) of the fan 604 for exhaust. In this embodiment, a sirocco fan is used for the fan 604 for exhaust.

In a conventional suspension type ventilating fan cum microwave oven, in a case where an exhaust path for ventilation is formed only by an inner structure of the microwave oven, the shape or the structure of the components are restricted, and therefore an efficient exhaust path cannot be provided.

On the other hand, in the heat cooking device of the third embodiment, the fan 604 for exhaust and the suction ports 602, 602 for ventilation are directly connected by use of the flexible ducts 603, 603, so that it is possible form an efficient exhaust path.

In the third embodiment, the heat cooking device of the first and the second embodiment maybe used for a microwave oven body 610, and a heat cooking device having other configuration may be used.

[Fourth Embodiment]

Figure 17:
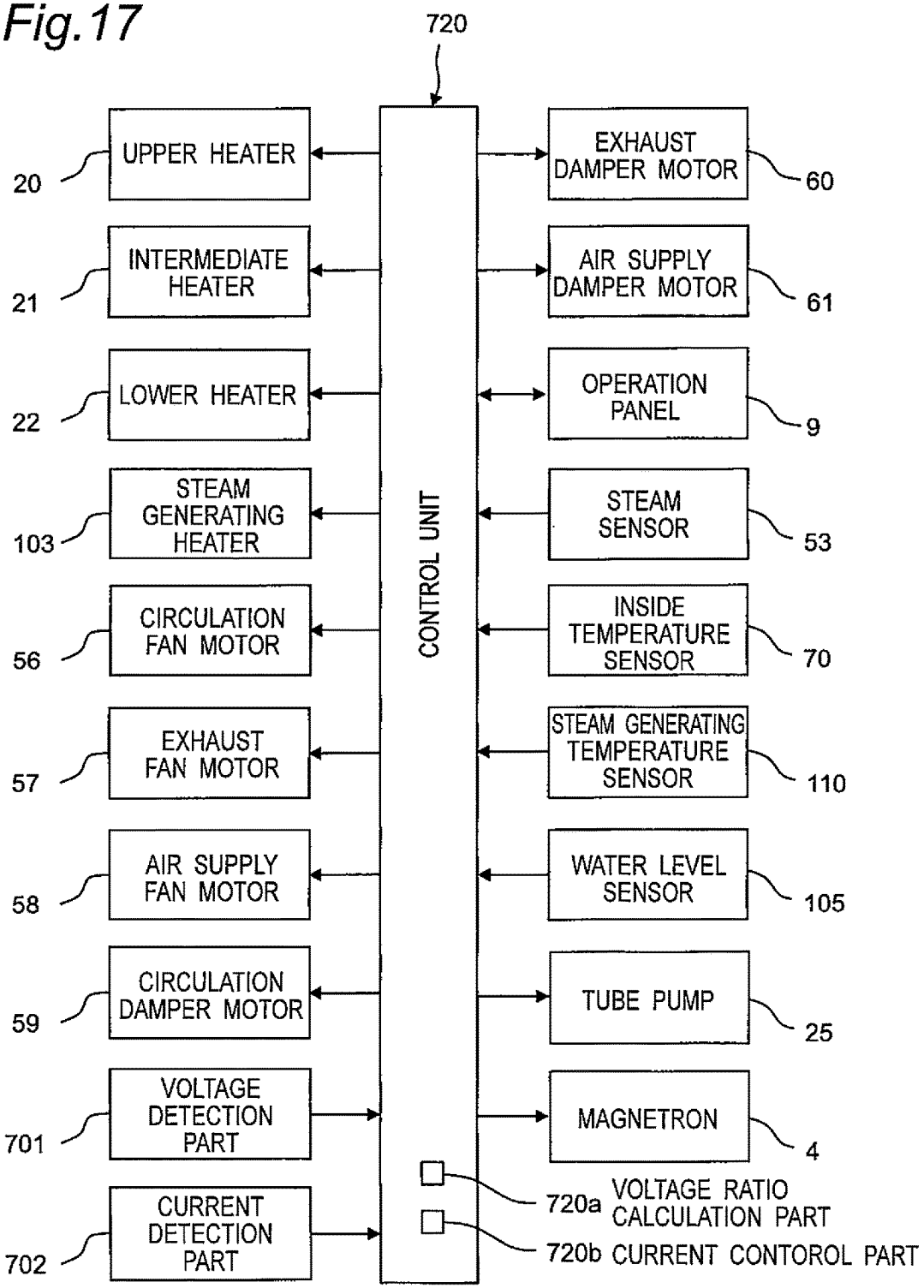
FIG. 17 is a control block diagram of a heat cooking device of a fourth embodiment of the present invention.

FIG. 17 is a control block diagram of a heat cooking device of a fourth embodiment of the present invention. The heat cooking device of this fourth embodiment has the same configuration of the heat cooking device of the first embodiment except operation of a voltage detection part 701, a current detection part 702, and a control device 720.

As illustrated in FIG. 17, the heat cooking device of this fourth embodiment includes a control device 720 composed of a microcomputer, an input output circuit, and the liked. In addition to the components connected to the control device 120 illustrated in FIG. 5, the voltage detection part 701 that detects an input voltage from an external power source (not illustrated), and the current detection part 702 that detects an input current of an inverter (not illustrated) for driving a magnetron 4 are connected to the control device 720.

In this heat cooking device, when the magnetron 4 is driven at an input voltage of a rated voltage (root-mean-square value) of 220 V, the rated input current of the inverter that drives the magnetron 4 is 12.88 A (root-mean-square value).

The control device 720 has a voltage ratio calculation part 720*a* that calculates the ratio of a rated voltage (220 V) and an input voltage detected by the voltage detection part 701, and a current control part 720*b* that controls an input current detected by the current detection part 702 in response to the ratio of the input voltage and the rated voltage (220 V). This current control part 720*b* controls the input current of the invertor based on the input voltage detected by the voltage detection part 701.

Specifically, conversion efficiency of the inverter in response to the change of the input voltage is as follows.

| Input Voltage | Conversion Efficiency (Cold) | Conversion Efficiency (Hot) |
|---|---|---|
| 187 V | 94.7% | 98.7% |
| 198 V | 96.5% | 98.4% |
| 209 V | 97.9% | 98.5% |
| 220 V | 99.0% | 97.7% |
| 231 V | 98.1% | 97.1% |
| 242 V | 98.5% | 97.4% |

Therefore, a target input current when the input current of the inverter is controlled is obtained by Target Input Current=220 V×12.88 A/(input voltage×conversion efficiency×0.01). For example, assuming that the input voltage is 187 V, the conversion efficiency (cold) is 94.7%, Target Input Current=220 V×12.88 A/(187 V×94.7×0.01) ≈16.00 A is established.

FIG. 18A is a table illustrating a relation of power consumption to an input voltage of a conventional heat cooking device, and FIG. 18B is a table illustrating a relation of power consumption to an input voltage of the heat cooking device of the fourth embodiment. In FIG. 18A and FIG. 18B, the "cold" is data in a case where a body temperature just before the relation of the power consumption to the input voltage is examined (temperature near a room temperature) is low, and the "hot" is data in a case where an oven is driven right before the relation of the power consumption to the input voltage is examined, and the body temperature is high.

In the conventional heat cooking device, as illustrated in FIG. 18A, the conversion efficiency of the inverter is changed in response to the change of the input voltage, and therefore output of microwaves from the magnetron 4 is similarly changed, and the finish of a cooked article is sometimes deteriorated. Additionally, in a case where a voltage more excessive than the rated voltage is input, the voltage is excessively input to the magnetron 4, and the magnetron 4 is brought into an unstable operation state.

On the other hand, in the heat cooking device of this fourth embodiment, as illustrated in FIG. 18B, the input current of the inverter is controlled by the current control part 720*b* such that a product of an input voltage detected by the voltage detection part 701, and an input current detected by the current detection part 702 is almost predetermined power 2805 W. Consequently, the finish of a cooked article is excellent, and the magnetron 4 can be stably operated regardless of the change of the input voltage.

As is clear from the "cold" and the "hot" illustrated in FIG. 18B, there is no difference in an effect of input current control regardless of the temperature of the body.

[Fifth Embodiment]

Now, a heat cooking device of a fifth embodiment of the present invention will be described. The heat cooking device of this fifth embodiment has the same configuration as the heat cooking device of the first embodiment except a function of a color liquid crystal display portion 10, and FIG. 1 is used.

The color liquid crystal display portion 10 of the heat cooking device of this fifth embodiment has a function of an electrostatic touch key. In normal use, the electrostatic touch key is operated as an operation button for heating cooking, and is in a low sensitivity mode in which when the color liquid crystal display portion 10 does not respond when the color liquid crystal display portion 10 is not touched.

On the other hand, during heating cooking or at standby, the function as the operation button of the electrostatic touch key is stopped, and the sensitivity of the electrostatic touch key is changed into a high sensitivity mode, and the color liquid crystal display portion is operated as a human sensor.

For example, during heating cooking or at standby, display and the operation button function of the color liquid crystal display portion 10 are turned off, and the human sensor function is turned on. When the human sensor detects that a human approaches again, the human sensor function is turned off, and the display and the operation button function of the color liquid crystal display portion 10 are turned on.

There are some conventional heat cooking devices including a function of turning off display at standby in order to reduce power consumption. However, in order to confirm a display content, a user needs to perform any operation (operation of pushing a button or opening a door), and convenience is not good.

On the other hand, in the heat cooking device of this fifth embodiment, while power consumption is reduced when a user is away, the display can be turned on when the user approaches. Consequently, the convenience is improved.

In the heat cooking device of the present invention, a microwave oven, a microwave and gas or electric oven, and the like use overheated steam or saturated steam, so that it is possible to perform healthy cooking. For example, in the heat cooking device of the present invention, overheated steam or saturated steam with a temperature of 100° C. or more is supplied to a food surface, and the overheated steam or the saturated steam adhered to the food surface is condensed, and a large amount of condensation latent heat is applied to a food, and therefore heat can be transferred to the food efficiently. Additionally, condensed water is adhered to the food surface, and salt and oil are dropped along with the condensed water, so that it is possible to reduce oil content and a salt content in the food. Furthermore, the inside of the heating chamber is filled with the overheated steam or the saturated steam, and is brought into a hypoxic state, so that it is possible to perform cooking suppressing oxidation of food. Herein, the hypoxic state means a state in which the volume percent of oxygen in the heating chamber is 10% or less (for example, 0.5% to 3%).

While the specific embodiments of the present invention are described, the present invention is not limited to the first to fourth embodiments, and various changes can be performed within the scope of the present invention.

The summary of the present invention and the embodiments is as follow.

The heat cooking device of the present invention includes:

the casing 1;

the heating chamber 2 disposed inside the casing 1; and the exhaust duct 300 having the outlet 310 provided on the rear edge side of the upper surface of the casing 1 such that exhaust air from the inside of the casing 1 is blown out forward, wherein the upper outer wall surface of the rear surface plate 200 of the casing 1 is covered by the exhaust duct 300 to form the exhaust passage P between the casing 1 and the exhaust duct 300, the bottom portion 101*p* of the exhaust passage P is inclined obliquely downward in one of the right and left directions of the casing 1, and the opening portion 330 is provided between the rear surface plate 200 of the casing 1 and the exhaust duct 300 on the lower side of the bottom portion of the exhaust passage P.

According to the configuration, the upper outer wall surface of the rear surface plate 200 of the casing 1 is covered by the exhaust duct 300, so that the exhaust passage P is formed between the outer wall surface of the rear surface plate 200 of the casing 1 and the exhaust duct 300, the bottom portion 101*p* of the exhaust passage P is inclined obliquely downward in one of the right and left directions of the casing 1, and the opening portion 330 is provided between the rear surface plate 200 of the casing 1 and the exhaust duct 300 on the lower side of the bottom portion 101*p* of the exhaust passage P, so that water infiltrating into the exhaust passage P from the upper surface side of the casing 1 through the outlet 310 of the exhaust duct 300 is guided obliquely downward in one of the right and left directions of the casing 1 along the inclined bottom portion inside the exhaust passage P, and exhausted to the outside from the opening portion 330 provided between the rear surface plate 200 of the casing 1 and the exhaust duct 300 on the lower side of the bottom portion 101*p* of the exhaust passage P. Therefore, even when the water is wrongly overflown on the upper surface of the casing 1, the overflown water can be prevented from infiltrating into the casing 1 through the outlet 310 of the exhaust duct 300.

The heat cooking device of one embodiment includes the guidance part (301 to 303, 201, 202) that is provided inside the exhaust passage P, and guides the water infiltrating into the exhaust passage P through the outlet 310 of the exhaust duct 300, downward inside the exhaust passage P, and the guidance part (301 to 303, 201, 202) includes the partition plates 301 to 303 erected on at least one of the inner wall surface of the exhaust duct 300 and the outer wall surface of the rear surface plate 200 of the casing 1.

According to the embodiment, the guidance part (301 to 303, 201, 202) including the partition plates 301 to 303 erected on the inner wall surface of the exhaust duct 300 guides, downward along the outer wall of the rear surface plate 200 of the casing 1, the water infiltrating into the exhaust passage P, and therefore when the exhaust duct 300 is resin-molded, the partition plates 301 to 303 can be formed at the same time, and the guidance part (301 to 303, 201, 202) can be formed with a simple configuration. The guidance part may include a partition plate erected on the outer wall surface of the rear surface plate 200 of the casing 1.

In the heat cooking device of one embodiment, the guidance part (301 to 303, 201, 202) includes at least one of the recess 201 and the protrusion 202 provided in the rear surface plate 200 of the casing 1.

According to the embodiment, the guidance part (301 to 303, 201, 202) that includes at least one of the recess 201 and the protrusion 202 provided in the rear surface plate 200 of the casing 1 guides, downward along the outer wall of the rear surface plate 200 of the casing 1, the water infiltrating into the exhaust passage P, and therefore the guidance part (301 to 303, 201, 202) can be formed with a simple configuration in which the rear surface plate 200 of the casing 1 is subjected to rugged working.

In the heat cooking device of one embodiment, the stepped part 201 recessed forward is provided on the upper side of the rear surface plate 200 of the casing 1, and the stepped part 201 of the casing 1 is covered by the exhaust duct 300, so that the outer wall surface of the exhaust duct 300 is located on the same plane as the outer wall surface below the stepped part 201, in the outer wall surface of the rear surface plate 200 of the casing 1, or the outer wall surface of the exhaust duct 300 is located in front of the outer wall surface below the stepped part 201, in the outer wall surface of the rear surface plate 200 of the casing 1.

According to the embodiment, the stepped part 201 provided on the upper side of the rear surface plate 200 of the casing 1 is recessed forward, and the outer wall surface of the exhaust duct 300 is formed to be located on the same plane as the outer wall surface below the stepped part 201, in the outer wall surface of the rear surface plate 200 of the casing 1 in a state where the stepped part 201 is covered by the exhaust duct 300, so that the rear surface of the casing 1 can be closely installed on the wall surface of the installation place.

Similarly, also in a case where the outer wall surface of the exhaust duct 300 is located in front of the outer wall surface below the stepped part 201, in the outer wall surface of the rear surface plate 200 of the casing 1, the rear surface of the casing 1 can be closely installed on the wall surface of the installation place.

In the heat cooking device of one embodiment, the exhaust air hole (203, 204) that blows out exhaust air from the inside of the casing 1 toward the exhaust passage P is provided on the upper side of the rear surface plate 200 of the casing 1, and the exhaust air hole (203, 204) is open rearward in the horizontal direction or in the obliquely downward direction.

According to the embodiment, the exhaust air hole (203, 204) that blows out the exhaust air from the inside of the casing 1 toward the exhaust passage P is open rearward in the horizontal direction or in the obliquely downward direction on the upper side of the rear surface plate 200 of the casing 1, so that while the water infiltrating into the exhaust passage P from the upper surface side of the casing 1 through the outlet 310 of the exhaust duct 300 is prevented from flowing downward to flow into the casing 1 from the exhaust air hole, the exhaust air from the inside of the casing 1 can be blown out from the outlet 310 of the exhaust duct 300 to the outside through the exhaust air hole (203, 204) and the exhaust passage P.

The heat cooking device of one embodiment includes the rib 313 provided in the right-left direction of the casing 1 so as to protrude obliquely upward from the lower side of the outlet 310 of the exhaust duct 300, and the groove 314 is formed between the rib 313 and the upper surface plate 350 of the casing 1 in the right-left direction of the casing 1.

According to the embodiment, apart of the water that has overflown on the upper surface of the casing 1 is drawn back by the rib 313 provided on the lower side of the outlet 310, and a part of the water that has overflown on the upper surface of the casing 1 is allowed to escape in the right-left direction by the groove 314 formed in the right-left direction of the casing 1, and therefore it is possible to reduce the amount of the water infiltrating into the exhaust passage P from the outlet 310.

DESCRIPTION OF REFERENCE SIGNS

1: Casing
2: Heating chamber
2*a*: Opening portion
3: Door
4: Magnetron
6: Dew receiver
7: Outer glass
8: Handle
9: Operation panel
10: Color liquid crystal display portion
11: Button group
12: Cancel key
13: Start key
14: Infrared ray receiving portion
15: Substance to be heated
16A, 16B: Upper shelf receiver
17A, 17B: Lower shelf receiver
18: Circulation duct
19: Circulation fan
20: Upper heater
21: Intermediate heater
22: Lower heater
23: Circulation damper
25: Tube pump
26: Water supply tank
27: Suction port
28: Upper outlet
29: First rear outlet
30: Second rear outlet
31: Third rear outlet
35: Steam tube
36: Steam pipe
37: Steam supply port
40: Water supply/exhaust tube
41: Water supply tank body
42: Communicating pipe
43: Tank cover
44: Tank joint portion
45: Natural exhaust port
46: First exhaust path
47: Exhaust fan
48: Forcible exhaust port
49: Exhaust damper
50: Air supply port
51: Air supply damper
52: Second exhaust path
53: Steam sensor
54: Air supply fan
55: Air supply path
56: Motor for circulation fan
57: Motor for exhaust fan
58: Motor for air supply fan
59: Motor for circulation damper
60: Motor for exhaust damper
61: Motor for air supply damper
70: Inside temperature sensor
91, 92: Cooking tray
100: Steam generator
101: Steam generating container
101*a* : Bottom portion
102: Lid portion
103: Steam generating heater
105: Water level sensor
105*a*, 105*b*: Electrode
110: Steam generating temperature sensor
120: Control device
200: Rear surface plate
201: Stepped part
202: Protrusion
203: Diluted exhaust air blow-out hole
204: Cooling air blow-out hole
300: Exhaust duct
301: Partition plate
301*a*: Cutout
302, 303: Partition plate
310: Outlet

313: Rib
314: Groove
320: Seal member
330: Opening portion
340: Power cord connection part
341: Power cord
350: Upper surface plate
400: Exhaust air unit
500: Cooking tray
501: Cooking tray base
502: Partition wall
600: Heat cooking device
601: Casing
602: Suction port for ventilation
603: Flexible duct
604: Fan for exhaust
605: Ventilation hole
701: Voltage detection part
702: Current detection part
720: Control device
720*a*: Voltage ratio calculation part
720*b*: Current control part

The invention claimed is:

1. A heat cooking device comprising:

a casing;

a heating chamber disposed inside the casing; and an exhaust duct having an outlet provided on a rear edge side of an upper surface of the casing such that exhaust air from an inside of the casing is blown out forward, wherein an upper outer wall surface of a rear surface plate of the casing is covered by the exhaust duct to form an exhaust passage between the casing and the exhaust duct, a bottom portion of the exhaust passage is inclined obliquely downward in one of right and left directions of the casing, an opening portion is provided between the rear surface plate of the casing and the exhaust duct on a lower side of the bottom portion of the exhaust passage, a stepped part recesses towards the rear surface plate and is provided on an upper side of the rear surface plate of the casing, and the stepped part of the casing is covered by the exhaust duct, so that an outer wall surface of the exhaust duct is located on the same plane as an outer wall surface of the rear surface plate of the casing below the stepped part, in the outer wall surface of the rear surface plate of the casing, or the outer wall surface of the exhaust duct is located in front of the outer wall surface of the rear surface plate of the casing below the stepped part, in the outer wall surface of the rear surface plate of the casing.

2. The heat cooking device as claimed in claim 1, further comprising:

a guidance part that is provided inside the exhaust passage, and guides the water infiltrating into the exhaust passage through the outlet of the exhaust duct, downward inside the exhaust passage, wherein the guidance part includes a partition plate erected on at least one of an inner wall surface of the exhaust duct and an outer wall surface of the rear surface plate of the casing.

3. The heat cooking device as claimed in claim 2, wherein the guidance part includes at least one of a recess and a protrusion provided in the rear surface plate of the casing.

4. The heat cooking device as claimed in claim 1, wherein an exhaust air hole that blows out exhaust air from the inside of the casing toward the exhaust passage is provided on an upper side of the rear surface plate of the casing such that exhaust air from the inside of the casing are blown out in a rearward and horizontal direction or in an obliquely downward direction with respect to the casing.

5. The heat cooking device as claimed in claim 1, further comprising:

a rib provided in a right-left direction of the casing so as to protrude obliquely upward from the upper surface plate of the casing, wherein a groove is formed between the rib and an upper surface plate of the casing in the right-left direction of the casing.

* * * * *